US011132868B2

(12) United States Patent
Loader et al.

(10) Patent No.: US 11,132,868 B2
(45) Date of Patent: Sep. 28, 2021

(54) SELECTIVELY REPLACING A VALUE PERSISTED ACROSS FEATURE INSTANCES IN AN ELECTRONIC GAMING DEVICE

(71) Applicant: Aristocrat Technologies Australia PTY Limited, Macquarie Park (AU)

(72) Inventors: James Loader, Springfield (AU); Zachary Murphy, Newtown (AU)

(73) Assignee: Aristocrat Technologies Australia Pty Limited, North Ryde (AU)

( * ) Notice: Subject to any disclaimer, the term of this patent is extended or adjusted under 35 U.S.C. 154(b) by 0 days.

(21) Appl. No.: 16/749,874

(22) Filed: Jan. 22, 2020

(65) Prior Publication Data

US 2021/0035412 A1 Feb. 4, 2021

(30) Foreign Application Priority Data

Jul. 31, 2019 (AU) ..... 2019210589

(51) Int. Cl.
*G07F 17/32* (2006.01)

(52) U.S. Cl.
CPC ..... *G07F 17/3267* (2013.01); *G07F 17/3211* (2013.01); *G07F 17/3258* (2013.01)

(58) Field of Classification Search
None
See application file for complete search history.

(56) References Cited

U.S. PATENT DOCUMENTS 7,722,457 B1 * 5/2010 Marks ..... G07F 17/3267 463/20
8,360,851 B2 1/2013 Aoki et al.
9,940,775 B2 4/2018 Eaton et al.
2003/0134673 A1 * 7/2003 Moody ..... G07F 17/3267 463/20
2009/0088241 A1 * 4/2009 Reed ..... G07F 17/326 463/25
2012/0094738 A1 * 4/2012 Aoki ..... G07F 17/34 463/20

(Continued)

OTHER PUBLICATIONS

Aristocrat Technologies Australia Pty Ltd., "Welcome to Fantastic Jackpots—Fantastic Cash," downloaded from www.aristocrat.com/anz/games/welcome-to-fantastic-jackpots-fantastic-cash/, 3 pp. (Aug. 2018).

*Primary Examiner* — Jason T Yen
(74) *Attorney, Agent, or Firm* — Klarquist Sparkman, LLP

(57) ABSTRACT

An electronic gaming device, including a display, a game controller with a processor, and memory, implements a feature having multiple instances. During the feature, for each instance, multiple symbols are selected from a set of symbols, which includes special symbols having associated values, and the selected symbols are displayed in a symbol array. A current value that is persisted across instances of the feature is also displayed. For an instance, a determination is made as to whether at least one selected special symbol has an associated value that is greater than the current value. If at least one selected special symbol has an associated value that is greater than the current value, the current value is replaced with the largest value associated with the at least one selected special symbol. A player is awarded an amount for the current value when all instances of the feature have been completed.

20 Claims, 24 Drawing Sheets

(56) References Cited

U.S. PATENT DOCUMENTS

| | | | | |
|---|---|---|---|---|
| 2016/0358412 | A1* | 12/2016 | Eaton | G07F 17/3223 |
| 2018/0361227 | A1* | 12/2018 | Ludwick | G07F 17/3267 |
| 2019/0385407 | A1* | 12/2019 | Hiten | G07F 17/3258 |

* cited by examiner

400

| | | Reel 1 (421) | Reel 2 (422) | Reel 3 (423) | Reel 4 (424) | Reel 5 (425) |
|---|---|---|---|---|---|---|
| 401 | 1 | K | 10 | J | A | 10 |
| 402 | 2 | SCAT2 | SCAT2 | SCAT2 | SCAT2 | SCAT2 |
| 403 | 3 | SCAT2 | SCAT2 | SCAT2 | SCAT2 | SCAT2 |
| 404 | 4 | SCAT2 | SCAT2 | SCAT2 | SCAT2 | SCAT2 |
| 405 | 5 | K | 10 | PIC1 | PIC2 | Q |
| 406 | 6 | 10 | PIC3 | PIC3 | K | PIC4 |
| 407 | 7 | PIC2 | PIC1 | A | PIC3 | K |
| 408 | 8 | PIC4 | PIC4 | PIC4 | Q | PIC3 |
| 409 | 9 | PIC1 | Q | K | WILD | A |
| 410 | 10 | J | PIC2 | PIC2 | WILD | PIC1 |
| 411 | 11 | Q | A | WILD | WILD | PIC2 |
| 412 | 12 | PIC2 | PIC3 | WILD | WILD | PIC3 |
| 413 | 13 | J | J | WILD | WILD | WILD |
| 414 | 14 | PIC4 | WILD | WILD | WILD | WILD |
| 415 | 15 | Q | WILD | WILD | WILD | WILD |
| 416 | 16 | K | WILD | WILD | WILD | WILD |
| 417 | 17 | PIC3 | WILD | WILD | WILD | WILD |
| 418 | 18 | A | WILD | WILD | PIC2 | WILD |
| 419 | 19 | J | WILD | WILD | PIC1 | WILD |
| 420 | 20 | PIC1 | WILD | 10 | A | WILD |
| 421 | 21 | A | WILD | PIC1 | K | WILD |
| 422 | 22 | PIC2 | WILD | Q | SCAT1 | J |
| 423 | 23 | Q | Q | PIC4 | J | PIC1 |
| 424 | 24 | PIC3 | PIC4 | 10 | PIC4 | 10 |
| 425 | 25 | 10 | A | SCAT1 | 10 | SCAT1 |
| 426 | 26 | PIC4 | K | Q | PIC3 | K |
| 427 | 27 | A | SCAT1 | PIC3 | Q | J |
| 428 | 28 | PIC3 | J | K | PIC1 | PIC2 |
| 429 | 29 | 10 | PIC2 | PIC2 | 10 | A |
| 430 | 30 | SCAT1 | K | J | PIC4 | PIC4 |
| 431 | 31 | PIC1 | PIC1 | A | J | Q |

440 434 436 446 444 442 432 438

FIG. 4

2400

| Special Symbol Weighting Table | |
|---|---|
| RNG number | Prize |
| 0-10,000 | MAJOR |
| 10,000-20,000 | MINOR |
| 20,000-30,000 | MINI |
| 30,000-130,000 | 50 |
| 130,000-230,000 | 20 |
| 230,000-330,000 | 15 |
| 330,000-430,000 | 10 |
| 430,000-530,000 | 5 |
| 530,000-630,000 | 4 |
| 630,000-730,000 | 3 |
| 730,000-830,000 | 2 |
| 830,000-1,500,000 | 1 |

*FIG. 24*

SELECTIVELY REPLACING A VALUE PERSISTED ACROSS FEATURE INSTANCES IN AN ELECTRONIC GAMING DEVICE

CROSS REFERENCE TO RELATED APPLICATION

This application claims priority to Australian Patent Application No. 2019210589, filed Jul. 31, 2019, the disclosure of which is hereby incorporated by reference.

FIELD

The present application relates to a gaming system and to a method of gaming.

BACKGROUND

Electronic gaming machines ("EGMs") or gaming devices provide a variety of wagering games such as slot games, video poker games, video blackjack games, roulette games, video bingo games, keno games and other types of games that are frequently offered at casinos and other locations. Play on EGMs typically involves a player establishing a credit balance by inputting money, or another form of monetary credit, and placing a monetary wager (from the credit balance) on one or more outcomes of an instance (or single play) of a primary or base game. In many games, a player may qualify for secondary games or bonus rounds by attaining a certain winning combination or triggering event in the base game. Secondary games provide an opportunity to win additional game instances, credits, awards, jackpots, progressives, etc. Awards from any winning outcomes are typically added back to the credit balance and can be provided to the player upon completion of a gaming session or when the player wants to "cash out."

"Slot" type games are often displayed to the player in the form of various symbols arrayed in a row-by-column grid or matrix. Specific matching combinations of symbols along predetermined paths (or paylines) through the matrix indicate the outcome of the game. The display typically highlights winning combinations/outcomes for ready identification by the player. Matching combinations and their corresponding awards are usually shown in a "pay-table" which is available to the player for reference. Often, the player may vary his/her wager to include differing numbers of paylines and/or the amount bet on each line. By varying the wager, the player may sometimes alter the frequency or number of winning combinations, frequency or number of secondary games, and/or the amount awarded.

Typical games use a random number generator ("RNG") to randomly determine the outcome of each game. The game is designed to return a certain percentage of the amount wagered back to the player (RTP=return to player) over the course of many plays or instances of the game. The RTP and randomness of the RNG are critical to ensuring the fairness of the games and are therefore highly regulated. Upon initiation of play, the RNG randomly determines a game outcome and symbols are then selected which correspond to that outcome. Notably, some games may include an element of skill on the part of the player and are therefore not entirely random.

SUMMARY

A gaming system is described that implements a base game and a feature game when the feature game is triggered by an outcome in the base game. If a feature is triggered, several feature games are implemented and a "big chip" symbol is displayed. The "big chip" symbol has a current prize amount that is persistent across all games of the feature. During the feature games, if a casino chip symbol appears that has a prize amount greater than the "big chip" prize amount, the casino chip prize amount replaces the "big chip" prize amount. After all feature games have been played, the player is awarded the current value of the "big chip" symbol.

A gaming system is described that comprises at least one display, a game controller that includes at least one processor and at least one memory device. The processor(s), the memory device (s), and the display(s) are operably connected, and the memory device(s) store computer-readable instructions for controlling the at least one processor to implement a feature including a plurality of games. During the feature, for each game, a plurality of symbols is selected from a set of symbols, the set of symbols including a plurality of special symbols, each special symbol having an associated prize amount, and the selected symbols are displayed in a symbol array. The feature also involves display of a current prize amount that is persistent across all games of the feature, and a determination as to whether at least one selected special symbol has an associated prize amount that is greater than the current prize amount. If the determination is that at least one special symbol has an associated prize amount that is greater than the current prize amount, the current prize amount is replaced with the largest prize amount associated with the at least one selected special symbol. A player is awarded the current prize amount when all games of the feature have been completed.

A method of gaming is described that involves implementing a feature including a plurality of games. For each game, the method comprises selecting a plurality of symbols from a set of symbols, the set of symbols including a plurality of special symbols, each special symbol having an associated prize amount, and displaying the selected symbols in a symbol array. A current prize amount is displayed that is persistent across all games of the feature, and the method involves determining whether at least one selected special symbol has an associated prize amount that is greater than the current prize amount. If the determination is that at least one special symbol has an associated prize amount that is greater than the current prize amount, the current prize amount is replaced with the largest prize amount associated with the at least one selected special symbol. The method also involves awarding the current prize amount to a player when all games of the feature have been completed.

The foregoing and other objects, features, and advantages of the invention will become more apparent from the following detailed description, which proceeds with reference to the accompanying figures.

BRIEF DESCRIPTION OF THE DRAWINGS

FIG. 4 illustrates an example reel strip layout.

FIG. 24 is an example representation of a special symbol weighting table used to select prize amounts for association with the special symbols.

DETAILED DESCRIPTION

Innovations are described for an electronic gaming device that includes a base game, such as a reel game with spinning reels of symbols, and feature game. The feature game can be triggered by an outcome in the base game. When the feature game is triggered, a current prize amount is set to an initial value, which is displayed. Multiple rounds (also called instances or, for a reel game, spins) of the feature game are then played consecutively, with the current prize amount being persisted across the multiple rounds and potentially increasing from round-to-round. For each round of the feature game, multiple symbols are selected from a set of symbols (e.g., by determining positions at which to stop reels that spin for the round). The selected symbols are displayed in a symbol array (e.g., shown as symbols of reels that have landed). The selected symbols can include one or more special symbols with associated prize amounts, which can be randomly assigned. During a round of the feature game, if a special symbol is selected that has an associated prize amount greater than the current prize amount, that higher associated prize amount replaces the current prize amount. After all rounds of the feature game have completed, the current prize amount is awarded. In some example implementations, the innovations improve usability of electronic gaming devices by enhancing the user experience for players, extending player time on the electronic gaming devices, and maintaining the interest of current players in the electronic gaming devices.

Figure 1:
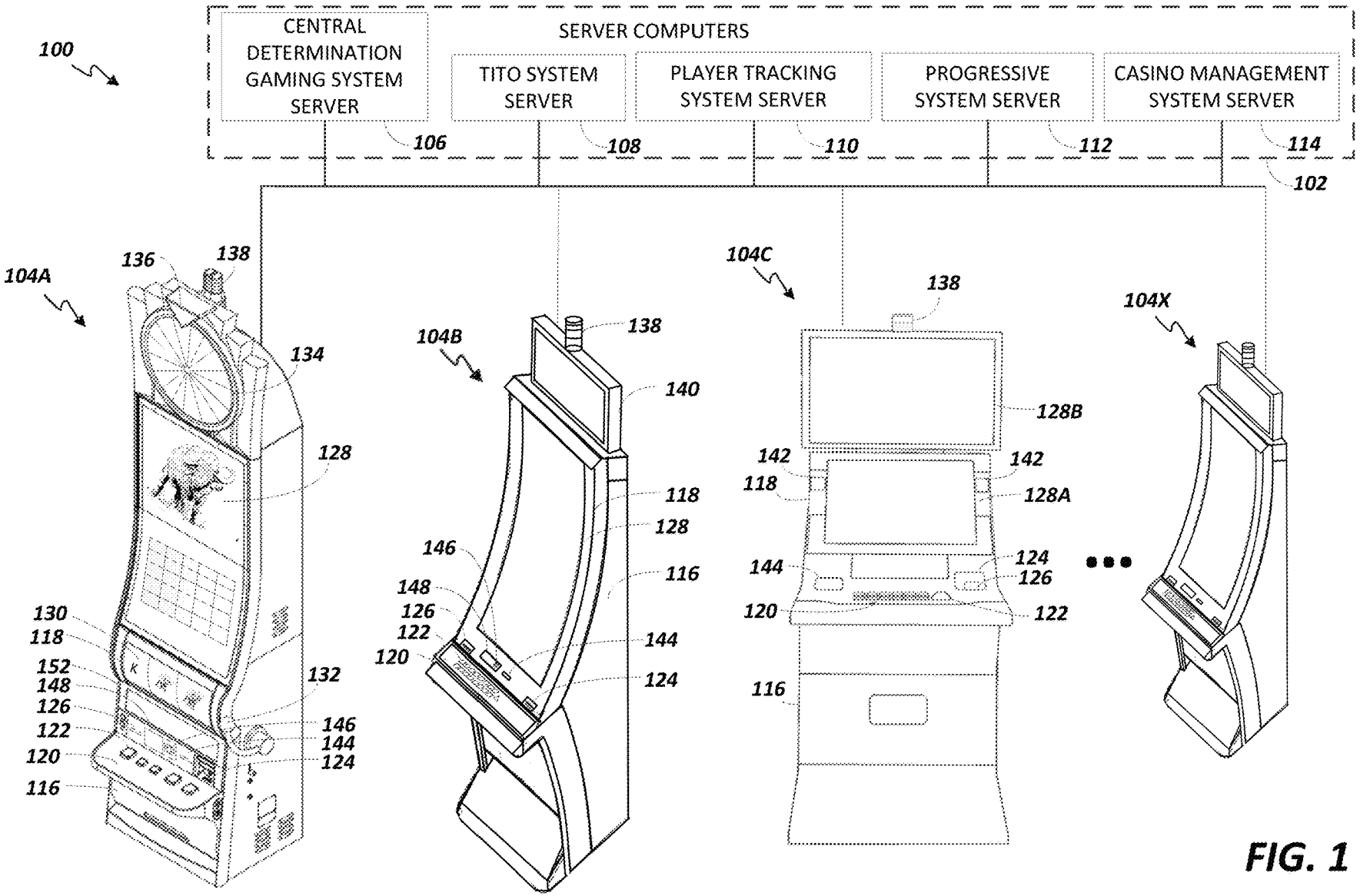
FIG. 1 is an exemplary diagram showing several electronic gaming machines ("EGMs") networked with various gaming related servers.

FIG. 1 illustrates several different models of EGMs which may be networked to various gaming related servers. The present invention can be configured to work as a system 100 in a gaming environment including one or more server computers 102 (e.g., slot servers of a casino) that are in communication, via a communications network, with one or more gaming devices 104A-104X (EGMs, slots, video poker, bingo machines, etc.). The gaming devices 104A-104X may alternatively be portable and/or remote gaming devices such as, but not limited to, a smart phone, a tablet, a laptop, or a game console.

Communication between the gaming devices 104A-104X and the server computers 102, and among the gaming devices 104A-104X, may be direct or indirect, such as over the Internet through a website maintained by a computer on a remote server or over an online data network including commercial online service providers, Internet service providers, private networks, and the like. In other embodiments, the gaming devices 104A-104X may communicate with one another and/or the server computers 102 over RF, cable TV, satellite links and the like.

In some embodiments, server computers 102 may not be necessary and/or preferred. For example, the present invention may, in one or more embodiments, be practiced on a stand-alone gaming device such as gaming device 104A, gaming device 104B or any of the other gaming devices 104C-104X. However, it is typical to find multiple EGMs connected to networks implemented with one or more of the different server computers 102 described herein.

The server computers 102 may include a central determination gaming system server 106, a ticket-in-ticket-out (TITO) system server 108, a player tracking system server 110, a progressive system server 112, and/or a casino management system server 114. Gaming devices 104A-104X may include features to enable operation of any or all servers for use by the player and/or operator (e.g., the casino, resort, gaming establishment, tavern, pub, etc.). For example, game outcomes may be generated on a central determination gaming system server 106 and then transmitted over the network to any of a group of remote terminals or remote gaming devices 104A-104X that utilize the game outcomes and display the results to the players.

Gaming device 104A is often of a cabinet construction which may be aligned in rows or banks of similar devices for placement and operation on a casino floor. The gaming device 104A often includes a main door which provides access to the interior of the cabinet. Gaming device 104A typically includes a button area or button deck 120 accessible by a player that is configured with input switches or buttons 122, an access channel for a bill validator 124, and/or an access channel for a ticket-out printer 126.

In FIG. 1, gaming device 104A is shown as a Relm XL™ model gaming device manufactured by Aristocrat® Technologies, Inc. As shown, gaming device 104A is a reel machine having a gaming display area 118 comprising a number (typically 3 or 5) of mechanical reels 130 with various symbols displayed on them. The reels 130 are independently spun and stopped to show a set of symbols within the gaming display area 118 which may be used to determine an outcome to the game. In embodiments where the reels are mechanical, mechanisms can be employed to implement greater functionality. For example, the boundaries of the gaming display area 118 may be defined by one or more mechanical shutters controllable by a processor. The mechanical shutters may be controlled to open and close, to correspondingly reveal and conceal more or fewer symbol positions from the mechanical reels 130. For example, a top boundary of the gaming display area 118 may be raised by moving a corresponding mechanical shutter upwards to reveal an additional row of symbol positions on stopped mechanical reels. Further, a transparent or translucent display panel may be overlaid on the gaming display area 118 and controlled to override or supplement what is displayed on one or more of the mechanical reel(s).

In many configurations, the gaming device 104A may have a main display 128 (e.g., video display monitor) mounted to, or above, the gaming display area 118. The main display 128 can be a high-resolution LCD, plasma, LED, or OLED panel which may be flat or curved as shown, a cathode ray tube, or other conventional electronically controlled video monitor.

In some embodiments, the bill validator 124 may also function as a "ticket-in" reader that allows the player to use a casino issued credit ticket to load credits onto the gaming device 104A (e.g., in a cashless ticket ("TITO") system). In such cashless embodiments, the gaming device 104A may also include a "ticket-out" printer 126 for outputting a credit ticket when a "cash out" button is pressed. Cashless TITO systems are well known in the art and are used to generate and track unique bar-codes or other indicators printed on tickets to allow players to avoid the use of bills and coins by loading credits using a ticket reader and cashing out credits using a ticket-out printer 126 on the gaming device 104A. In some embodiments a ticket reader can be used which is only capable of reading tickets. In some embodiments, a different form of token can be used to store a cash value, such as a magnetic stripe card.

In some embodiments, a player tracking card reader 144, a transceiver for wireless communication with a player's smartphone, a keypad 146, and/or an illuminated display 148 for reading, receiving, entering, and/or displaying player tracking information is provided in gaming device 104A. In such embodiments, a game controller within the gaming device 104A can communicate with the player tracking server system 110 to send and receive player tracking information.

Gaming device 104A may also include a bonus topper wheel 134. When bonus play is triggered (e.g., by a player achieving a particular outcome or set of outcomes in the primary game), bonus topper wheel 134 is operative to spin and stop with indicator arrow 136 indicating the outcome of the bonus game. Bonus topper wheel 134 is typically used to play a bonus game, but it could also be incorporated into play of the base or primary game.

A candle 138 may be mounted on the top of gaming device 104A and may be activated by a player (e.g., using a switch or one of buttons 122) to indicate to operations staff that gaming device 104A has experienced a malfunction or the player requires service. The candle 138 is also often used to indicate a jackpot has been won and to alert staff that a hand payout of an award may be needed.

There may also be one or more information panels 152 which may be a back-lit, silkscreened glass panel with lettering to indicate general game information including, for example, a game denomination (e.g., $0.25 or $1), pay lines, pay tables, and/or various game related graphics. In some embodiments, the information panel(s) 152 may be implemented as an additional video display.

Gaming devices 104A have traditionally also included a handle 132 typically mounted to the side of main cabinet 116 which may be used to initiate game play.

Figure 2:
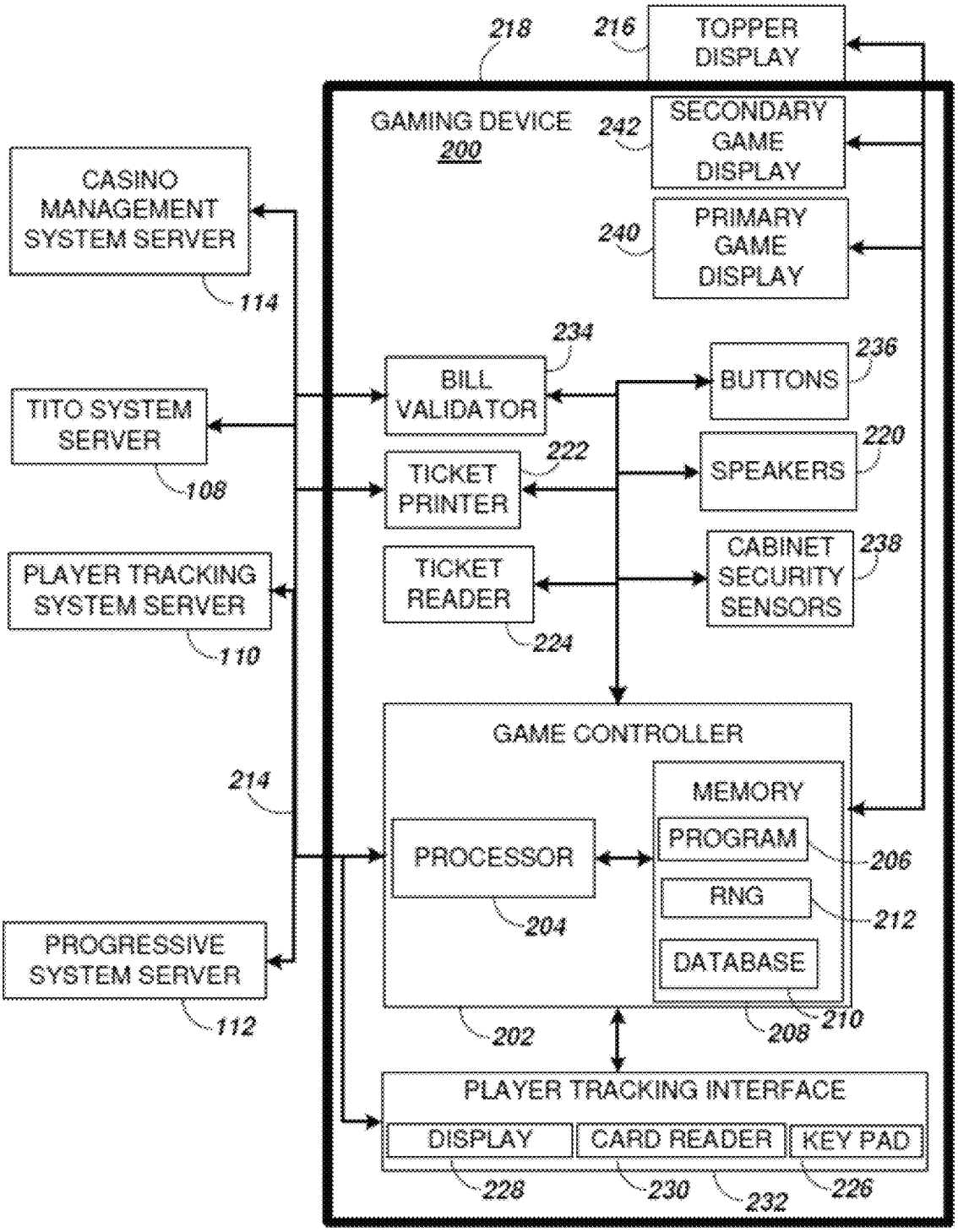
FIG. 2 is a block diagram showing various functional elements of an exemplary EGM.

Many or all the above described components can be controlled by circuitry (e.g., a gaming controller) housed inside the main cabinet 116 of the gaming device 104A, the details of which are shown in FIG. 2.

Note that not all gaming devices suitable for implementing embodiments of the present invention necessarily include top wheels, top boxes, information panels, cashless ticket systems, and/or player tracking systems. Further, some suitable gaming devices have only a single game display that includes only a mechanical set of reels and/or a video display, while others are designed for bar counters or table tops and have displays that face upwards.

An alternative example gaming device 104B illustrated in FIG. 1 is the Arc™ model gaming device manufactured by Aristocrat® Technologies, Inc. Note that where possible, reference numerals identifying similar features of the gaming device 104A embodiment are also identified in the gaming device 104B embodiment using the same reference numbers. Gaming device 104B does not include physical reels and instead shows game play functions on main display 128. An optional topper screen 140 may be used as a secondary game display for bonus play, to show game features or attraction activities while a game is not in play, or any other information or media desired by the game designer or operator. In some embodiments, topper screen 140 may also or alternatively be used to display progressive jackpot prizes available to a player during play of gaming device 104B.

Example gaming device 104B includes a main cabinet 116 including a main door which opens to provide access to the interior of the gaming device 104B. The main or service door is typically used by service personnel to refill the ticket-out printer 126 and collect bills and tickets inserted into the bill validator 124. The door may also be accessed to reset the machine, verify and/or upgrade the software, and for general maintenance operations.

Another example gaming device 104C shown is the Helix™ model gaming device manufactured by Aristocrat® Technologies, Inc. Gaming device 104C includes a main display 128A that is in a landscape orientation. Although not illustrated by the front view provided, the landscape display 128A may have a curvature radius from top to bottom, or alternatively from side to side. In some embodiments, display 128A is a flat panel display. Main display 128A is typically used for primary game play while secondary display 128B is typically used for bonus game play, to show game features or attraction activities while the game is not in play or any other information or media desired by the game designer or operator.

Many different types of games, including mechanical slot games, video slot games, video poker, video black jack, video pachinko, keno, bingo, and lottery, may be provided with or implemented within the depicted gaming devices 104A-104C and other similar gaming devices. Each gaming device may also be operable to provide many different games. Games may be differentiated according to themes, sounds, graphics, type of game (e.g., slot game vs. card game vs. game with aspects of skill), denomination, number of paylines, maximum jackpot, progressive or non-progressive, bonus games, and may be deployed for operation in Class 2 or Class 3, etc.

FIG. 2 is a block diagram depicting exemplary internal electronic components of a gaming device 200 connected to various external systems. All or parts of the example gaming device 200 shown could be used to implement any one of the example gaming devices 104A-X depicted in FIG. 1. The games available for play on the gaming device 200 are controlled by a game controller 202 that includes one or more processors 204 and a game that may be stored as game software or a program 206 in a memory 208 coupled to the processor 204. The memory 208 may include one or more mass storage devices or media that are housed within gaming device 200. Within the mass storage devices and/or memory 208, one or more databases 210 may be provided for use by the program 206. A random number generator (RNG) 212 that can be implemented in hardware and/or software is typically used to generate random numbers that are used in the operation of game play to ensure that game play outcomes are random and meet regulations for a game of chance. In some embodiments, the random number generator 212 is a pseudo-random number generator.

Alternatively, a game instance (i.e., a play or round of the game) may be generated on a remote gaming device such as a central determination gaming system server 106 (not shown in FIG. 2 but see FIG. 1). The game instance is communicated to gaming device 200 via the network 214 and then displayed on gaming device 200. Gaming device 200 may execute game software, such as but not limited to video streaming software that allows the game to be displayed on gaming device 200. When a game is stored on gaming device 200, it may be loaded from a memory 208 (e.g., from a read only memory (ROM)) or from the central determination gaming system server 106 to memory 208. The memory 208 may include RAM, ROM or another form of storage media that stores instructions for execution by the processor 204.

The gaming device 200 may include a topper display 216 or another form of a top box (e.g., a topper wheel, a topper screen, etc.) which sits above main cabinet 218. The gaming cabinet 218 or topper display 216 may also house a number of other components which may be used to add features to a game being played on gaming device 200, including speakers 220, a ticket printer 222 which prints bar-coded tickets or other media or mechanisms for storing or indicating a player's credit value, a ticket reader 224 which reads bar-coded tickets or other media or mechanisms for storing or indicating a player's credit value, and a player tracking interface 232. The player tracking interface 232 may include a keypad 226 for entering information, a player tracking display 228 for displaying information (e.g., an illuminated or video display), a card reader 230 for receiving data and/or communicating information to and from media or a device such as a smart phone enabling player tracking. Ticket printer 222 may be used to print tickets for a TITO system server 108. The gaming device 200 may further include a bill validator 234, buttons 236 for player input, cabinet security sensors 238 to detect unauthorized opening of the cabinet 218, a primary game display 240, and a secondary game display 242, each coupled to and operable under the control of game controller 202.

Gaming device 200 may be connected over network 214 to player tracking system server 110. Player tracking system server 110 may be, for example, an OASIS® system manufactured by Aristocrat® Technologies, Inc. Player tracking system server 110 is used to track play (e.g., amount wagered, games played, time of play and/or other quantitative or qualitative measures) for individual players so that an operator may reward players in a loyalty program. The player may use the player tracking interface 232 to access his/her account information, activate free play, and/or request various information. Player tracking or loyalty programs seek to reward players for their play and help build brand loyalty to the gaming establishment. The rewards typically correspond to the player's level of patronage (e.g., to the player's playing frequency and/or total amount of game plays at a given casino). Player tracking rewards may be complimentary and/or discounted meals, lodging, entertainment and/or additional play. Player tracking information may be combined with other information that is now readily obtainable by a casino management system.

Gaming devices, such as gaming devices 104A-104X, 200, are highly regulated to ensure fairness and, in many cases, gaming devices 104A-104X, 200 are operable to award monetary awards (e.g., typically dispensed in the form of a redeemable voucher). Therefore, to satisfy security and regulatory requirements in a gaming environment, hardware and software architectures are implemented in gaming devices 104A-104X, 200 that differ significantly from those of general-purpose computers. Adapting general-purpose computers to function as gaming devices 200 is not simple or straightforward because of: 1) the regulatory requirements for gaming devices 200, 2) the harsh environment in which gaming devices 200 operate, 3) security requirements, 4) fault tolerance requirements, and 5) the requirement for additional special-purpose componentry enabling functionality of an EGM. These differences require substantial engineering effort with respect to game design implementation, hardware components and software.

When a player wishes to play the gaming device 200, he/she can insert cash or a ticket voucher through a coin acceptor (not shown) or bill validator 234 to establish a credit balance on the gamine machine. The credit balance is used by the player to place wagers on instances of the game and to receive credit awards based on the outcome of winning instances. The credit balance is decreased by the amount of each wager and increased upon a win. The player can add additional credits to the balance at any time. The player may also optionally insert a loyalty club card into the card reader 230. During the game, the player views the game outcome on the game displays 240, 242. Other game and prize information may also be displayed.

For each game instance, a player may make selections, which may affect play of the game. For example, the player may vary the total amount wagered by selecting the amount bet per line and the number of lines played. In many games, the player is asked to initiate or select options during course of game play (such as spinning a wheel to begin a bonus round or select various items during a feature game instance). The player may make these selections using the player-input buttons 236, the primary game display 240 which may be a touch screen, or using some other input device which enables a player to input information into the gaming device 200. In some embodiments, a player's selection may apply across a plurality of game instances. For example, if the player is awarded additional game instances in the form of free games, the player's prior selection of the amount bet per line and the number of lines played may apply to the free games. The selections available to a player will vary depending on the embodiment. For example, in some embodiments a number of pay lines may be fixed. In other embodiments, the available selections may include different numbers of ways to win instead of different numbers of pay lines.

During certain game events, the gaming device 200 may display visual and auditory effects that can be perceived by the player. These effects add to the excitement of a game, which makes a player more likely to enjoy the playing experience. Auditory effects include various sounds that are projected by the speakers 220. Visual effects include flashing lights, strobing lights or other patterns displayed from lights on the gaming device 200 or from lights behind the information panel 152 (FIG. 1).

When the player is done, he/she cashes out the credit balance (typically by pressing a cash out button to receive a ticket from the ticket printer 222). The ticket may be "cashed-in" for money or inserted into another machine to establish a credit balance for play.

Some embodiments described herein represent improvements in the technical area of EGM software and provide new technology, in that they improve usability of EGMs by enhancing the user experience for players, extending player time on the EGMs, and maintaining the interest of current players in the EGMs. In particular, the staging of operations, as a current prize amount is selectively replaced across rounds of a feature, may provide a build up to higher award amounts, which may occur as a reward to players for extended play on the gaming device 200. These embodiments are thus not merely new game rules or new display patterns.

Figure 3:
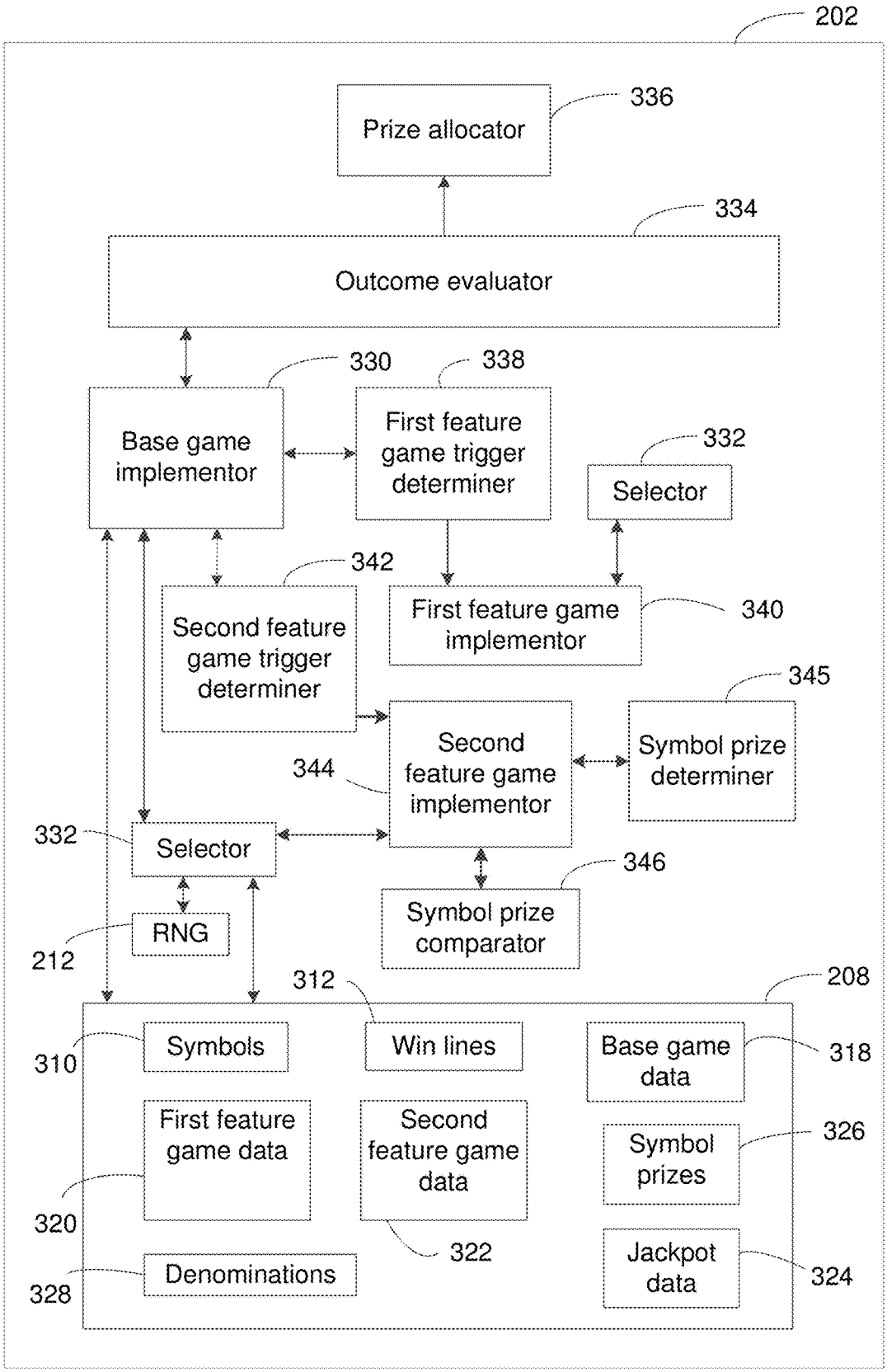
FIG. 3 is a block diagram showing functional components implemented by a game controller.

FIG. 3. illustrates a block diagram showing functional components implemented by the game controller 202. In this example, the functional components comprise data stored in the memory 208, including data indicative of symbols 310; data indicative of win lines 312; base game data 318 defining characteristics of a base game; first feature game data 320 defining characteristics of a first feature; second feature game data 322 defining characteristics of a second feature; and jackpot data 324 defining characteristics of available bonus and progressive jackpot arrangements, including characteristics of accumulation and awarding of jackpots, and current bonus and jackpot amounts. The memory 208 also includes symbol prize data 326 indicative of prizes associated with defined special symbols, and denomination data 328 indicative of available denomination amounts.

The functional components also include a base game implementer 330 arranged to implement base games using a selector 332 to select symbols using the symbols data 310 for display at a plurality of symbol positions in a symbol array using the random number generator 212. Outcomes of a base game are determined by an outcome evaluator 334 and any applicable prize is awarded by a prize allocator 336, for example, based on a base game pay table.

The functional components also include a first feature game trigger determiner 338 arranged to make a determination based on an event during a base game as to whether to commence a first feature that includes at least one first feature game instance, for example, based on whether a first trigger condition has occurred during the base game such as selection and display of a defined number of first trigger symbols during the base game. In an example, selection and display of at least 6 first trigger symbols constitutes a first trigger condition, although it will be understood that any suitable first trigger condition is envisaged.

The first feature is implemented by a first feature game implementor 340, and in this example the first feature is a 'hold and spin' feature wherein each display position in an array of display positions is associated with a respective set of symbols that includes at least one defined feature symbol. Each feature symbol has an associated prize amount selected randomly or pseudo randomly, for example, using one or more suitable weighting table(s) and the random number generator 212, and each feature symbol that is selected and displayed during the first feature becomes persistent. After all first feature game instances have been played, the prize amounts associated with all selected and displayed feature symbols are summed and a prize corresponding to the summed amount is awarded to the player. However, it will be understood that any suitable first feature is envisaged.

The prize amount associated with a feature symbol may be a defined prize amount, such as an amount equal to the amount of credits bet multiplied by 1, 2, 3, 4, 5, 8, 10, 15, 20, 25, 30, 50, 100, 200 or 250, or may be an amount derived from a bonus pool and/or progressive jackpot pool. In this example, 3 different bonus prizes—MINI, MINOR and MAJOR—are provided of increasing size, with each bonus prize being dependent on the selected bet denomination, such that the magnitude of the bonus prize increases with increasing bet denomination. In this example, two progressive-type jackpots are provided—MEGA and GRAND—of increasing size, wherein the gaming device progressively contributes an amount of credits to one or more jackpot pools based, for example, on defined conditions during game play. In this example, the GRAND jackpot is contributed to by multiple gaming machines and the MEGA jackpot is contributed to by only by 1 gaming machine. The available prize amounts may vary depending on the selected denomination.

The functional components also include a second feature game trigger determiner 342 arranged to make a determination based on an event during a base game as to whether to commence a second feature that includes at least one second feature game instance, for example, based on whether a second trigger condition has occurred during the base game such as selection and display of a defined number of second trigger symbols during the base game. In an example, selection and display of at least 3 second trigger symbols constitutes a second trigger condition, although it will be understood that any suitable second trigger condition is envisaged.

The second feature is implemented by a second feature game implementor 344. During the second feature, a plurality of special symbols are provided with each special symbol associated with a selected prize amount, in this example selected randomly or pseudo randomly by a symbol prize determiner 345 using at least one special symbol weighting table 2400, as shown in FIG. 24, and the random number generator 212. A current prize amount is prominently displayed, for example, such that the current prize amount is indicated by indicia that is larger than indicia indicating the special symbol prize amounts, and after each game of the second feature, a comparison is made by a symbol prize comparator 346 as to whether any selected and displayed special symbols have a prize amount that is larger than the current prize amount and, if so, the largest displayed prize amount replaces the current prize amount. The current prize amount remains for all subsequent game instances in the second feature and, in this way, the current prize amount potentially increases over several second feature game instances. The special symbols may be the same as or different to the symbols used during the first feature as feature symbols.

The prize amount associated with the special symbols may be a defined prize amount, such as an amount equal to the amount of credits bet multiplied by 1, 2, 3, 4, 5, 8, 10, 15, 20, 25, 30, 50, 100, 200 or 250, or may be an amount derived from a bonus pool, which may correspond to the MINI, MINOR and MAJOR bonus pools, and/or a progressive jackpot pool, which may correspond to the MEGA or GRAND jackpot pools. The available prize amounts may vary depending on the selected denomination.

Multiple types of special symbol may be provided to reflect relative value based on the prize amounts associated with the special symbols. For example, the special symbol may be a representation of a casino chip with a displayed value corresponding to the allocated prize amount, and multiple colors of the casino chip provided, such as gold for prize amounts greater than 100× the bet amount, for the MEGA jackpot and the MINI, MINOR and MAJOR bonus amounts; silver for prize amounts greater than 5× the bet amount and less than 100× the bet amount; and bronze for prize amounts less than or equal to 5× the bet amount.

After completion of all game instances in the second feature, the current prize amount is awarded to the player by the prize allocator 336.

Outcomes of the first and second features are in this example also determined by the outcome evaluator 334 and any applicable prize is awarded by the prize allocator 336.

In terms of technical effects, innovative aspects of selectively replacing a current amount that is persisted between instances of a feature represent improvements in the technical area of EGM software and provide new technology, in that they improve usability of EGMs by enhancing the user experience for players, extending player time on the EGMs, and maintaining the interest of current players in the EGMs. In some example implementations, the selective replacement of the current amount is visible to players. In particular, the selective replacement of the current amount may provide a build up to higher award amounts, which may occur as a reward to players for extended play. These embodiments are thus not merely new game rules or new display patterns.

FIG. 4 illustrates an example of a set 400 of five reel strips 421, 422, 423, 424, 425. In the example, each reel strip has 31 reel strip positions 401-431. Each reel strip position of each reel has a symbol. For example, a "Wild" symbol 432 occupies the 13th reel strip position 413 of the fifth reel 425. Other reels strips to those illustrated in FIG. 4 can be used, for example, reel strips that have up to 100 reel strip positions. The actual length of the feature game reel strips would depend on factors such as the number of wild symbols (in general, the more wilds there are, the longer the reel strip needs to be to maintain the target RTP), and volatility (in general, the higher the prize value is, the longer the reel strip needs to be to lower the hit rate to maintain the target RTP). In this example, in addition to the WILD symbols 432, the symbols also include standard symbols 434, picture symbols 436, first scatter symbols 438 that correspond to the second trigger symbols, and second scatter symbols 440 that correspond to the first trigger symbols. In this example, the second scatter symbols 440 also correspond to the feature symbols used in the first feature and the special symbols used during the second feature.

Figure 5:
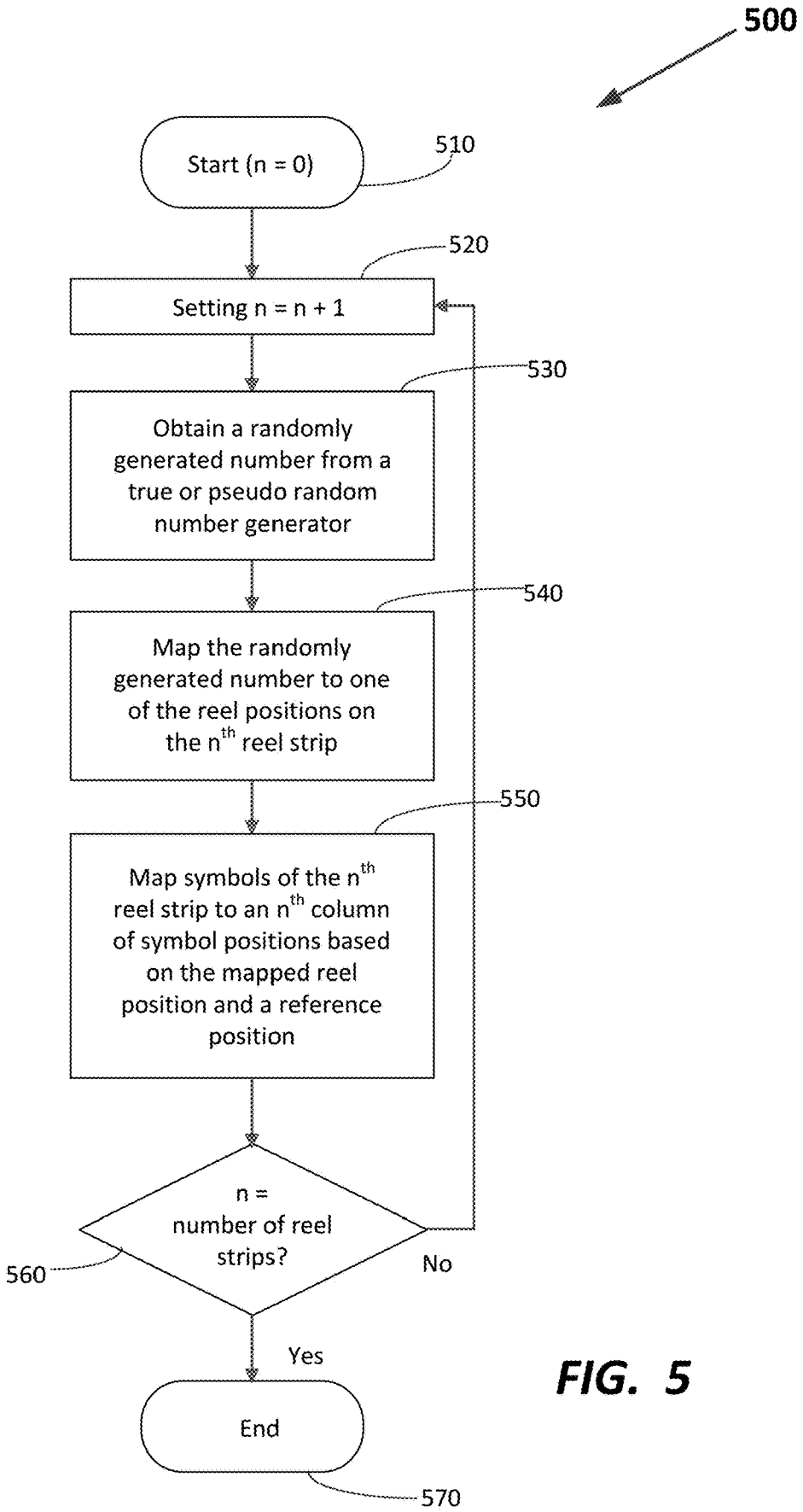
FIG. 5 is a flow chart of an example symbol selection method.

FIG. 5 is a flow chart of a method 500 carried out by the processor 204 to select symbols from reel strips. At step 510, the processor 204 starts the process of selecting symbols with a counter (n) set at zero as symbols have not yet been selected from any reel strips. At step 520, the processor 204 increments the counter. In the first iteration, the counter is set to 1 to reflect that symbols are to be selected from a first reel strip. At step 530 the processor obtains a randomly generated number from a true or pseudo random number generator 212. At step 540 the processor maps the generated number to one of the reel positions of the nth reel strip. In the first iteration, this is the first reel strip. To map the generated number to one of the reel positions, the possible values that can be returned from the RNG 212 are divided into ranges and associated with specific ones of the reel positions in memory 208. In one example, these ranges are stored as a look-up table. In one example, the ranges are each the same size so that each of the reel strip positions has the same chance of being selected. In other examples, the ranges may be arranged to weight the relative chances of selecting specific reel strip positions. The reel strips may be of different lengths.

At step 550, the processor 204 maps symbols of the nth reel strip to an nth column of symbol display positions based on the mapped reel position and a reference position. In an example, the reference position is the bottom position of the symbol positions of each column of symbol positions. In this example, the selected reel position (and hence the symbol at this position) is mapped to the bottom symbol position of the column. In an example, there are two other symbol positions in the column of symbol positions and hence symbols at two neighboring reel strip positions are also mapped to the symbol positions of the column. Referring to the example reel strips of FIG. 4, if the value returned by the RNG 212 is mapped to reel position 413, then for the first reel strip 421, "J" symbol 442 is mapped to a bottom symbol position, "PIC2" symbol 444 is mapped to a middle symbol position, and "Q" symbol 446 is mapped to a top symbol position.

At step 560, the processor 204 determines whether symbols have been selected for all of the reel strips, and if not the processor reverts to step 520 and iterates through steps 530, 540 and 550 until it is determined at step 560 that symbols have been selected from all n reel strips and mapped to all n columns of symbol positions, after which the symbol selection process ends 570. Different numbers of symbols may be mapped to different numbers of symbol positions.

After the symbols of all reel strips have been mapped to symbol positions, the processor 204 controls display 240 to display them at the symbol positions of the symbol array.

An example implementation will now be described in relation to flow diagrams shown in FIGS. 6 and 7, screens displayed to a player on an example gaming machine, as shown in FIGS. 8 to 23, and the weighting table 2400 shown in FIG. 24.

Figure 6:
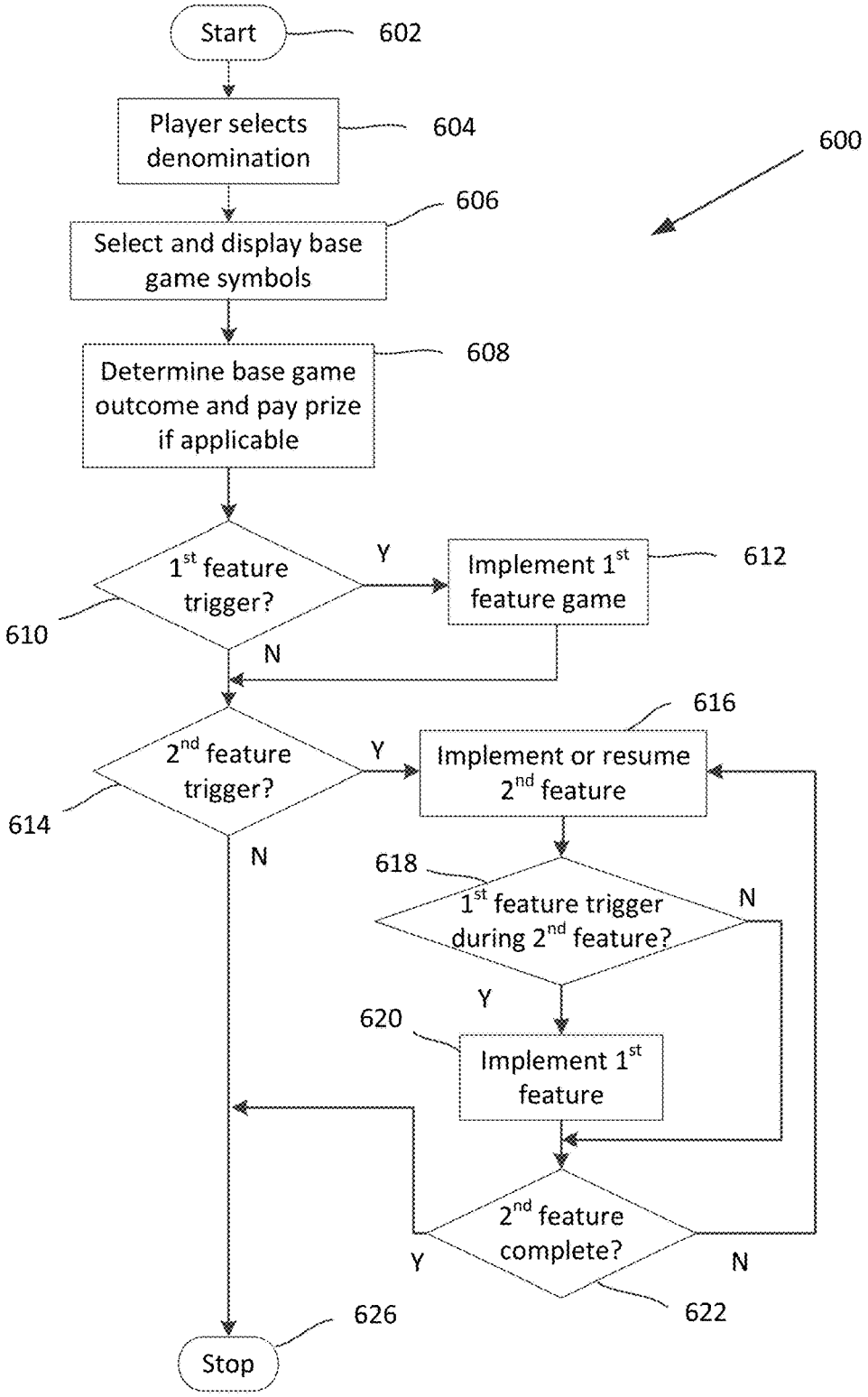
FIG. 6 is a flow chart illustrating an example game play process of an example method of gaming.

A flow chart 600 illustrating an example process for implementing a game play process is shown in FIG. 6.

As shown, prior to implementation of a base game, a player first selects a denomination that will be used for bets during the base games, as indicated at step 604. In this example, the available denominations are 1c, 2c, 5c, 10c and $1, although it will be understood that any suitable denomination is envisaged.

Figure 8:
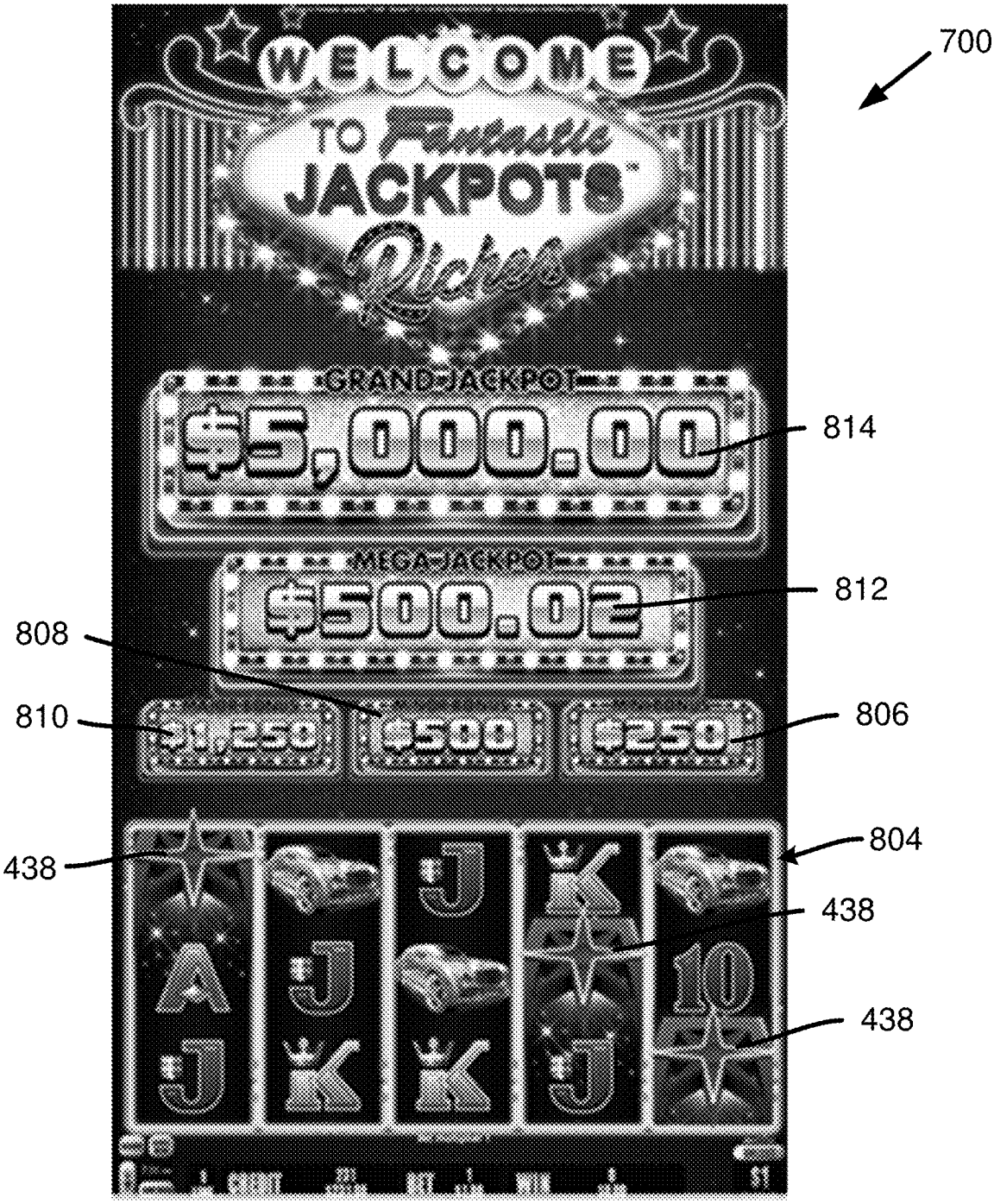
FIG. 8 is an example representation of a screen of an EGM during implementation of a base game when a feature trigger condition exists.

A representation 800 of a screen displayed to a player on a gaming machine during implementation of a base game is shown in FIG. 8.

After selection of the denomination, the selector 332 under control of the base game implementor 330 selects several symbols 310 using the random number generator process described in relation to FIGS. 4 and 5, and displays the selected symbols in a symbol array 804, as indicated at step 606. An outcome of the base game is then determined by the outcome determiner 334 and a prize is awarded by the prize allocator 336 if applicable, as indicated at step 608.

As indicated at steps 610, 612, 614 and 616, if a first trigger condition exists during the base game, a first feature is implemented, and if a second trigger condition exists during the base game, a second feature is implemented. If both first and second trigger conditions exist during the base game, the first feature is implemented first followed by the second feature.

In this example, the first trigger condition comprises selection and display of 6 or more first trigger symbols, in this example 6 or more second scatter symbols 440 (SCAT2) at any display positions of the symbol array, although it will be understood that any suitable first trigger condition is envisaged. In this example, the SCAT2 symbol 440 is a representation of a casino chip.

In this example, the second trigger condition comprises selection and display of 3 or more second trigger symbols, in this example 3 or more first scatter symbols 438 (SCAT1) at any display positions of the symbol array, although it will be understood that any suitable second trigger condition is envisaged. In this example, the SCAT1 symbol 438 is a representation of a star.

FIG. 8 also shows MINI, MINOR and MAJOR bonus amounts 806, 808, 810, a MEGA progressive jackpot amount 812, and a GRAND progressive jackpot amount 814 that are also visible on all screens displayed to the player during the base game and the first and second feature game instances.

In this example, the first feature includes a 'hold and spin' type game wherein 15 symbols are displayed in a 3×5 array and each symbol in the array is associated with an individual reel strip that, for example, has 50 symbols including 6 feature symbols, in this example 6 SCAT2 symbols. In this example, for each game in the first feature, each SCAT2 symbol 440 is associated with a prize amount that may be 1×, 2×, 3×, 4×, 5×, 6×, 7×, 8, 10×, 15×, 20× or 50× the credit bet amount, the MINI, MINOR or MAJOR bonus amount, or the current value of the MEGA progressive jackpot amount. The prize amount associated with each SCAT2 symbol is determined using the random number generator 212 and the special symbol weighting table 2400 shown in FIG. 24, wherein selection of a number by the random number generator 212 is mapped to the weighting table and therefore a defined prize amount. However, it will be understood that any suitable arrangement for determining the prize amount for each feature (SCAT2) symbol is envisaged.

During each first feature game instance, 15 symbols are selected and displayed in the symbol matrix. If a feature symbol is selected and displayed, the prize amount associated with the selected feature symbol is also displayed. The selected and displayed feature symbol also becomes persistent for all remaining game instances of the first feature.

In this example, 3 feature game instances are provided in the first feature, with the number of feature game instances resetting to 3 when at least one feature symbol 440 is selected and displayed during the feature game instance. Accordingly, if no feature symbol 440 is selected for 3 successive feature game instances, the first feature will end.

After completion of all feature game instances of the first feature, the sum of all prize amounts associated with the displayed feature symbols 440 is calculated and awarded to the player by the prize allocator 336.

In this example, as indicated at steps 618 and 620, during the second feature it is possible to trigger the first feature if a first trigger condition occurs, in this example selection and display of 6 or more first trigger symbols (SCAT2 440). If the first trigger condition occurs at step 618 and after the first feature has been implemented at step 620, the second feature continues at step 616 unless it is complete at step 622.

Figure 7:
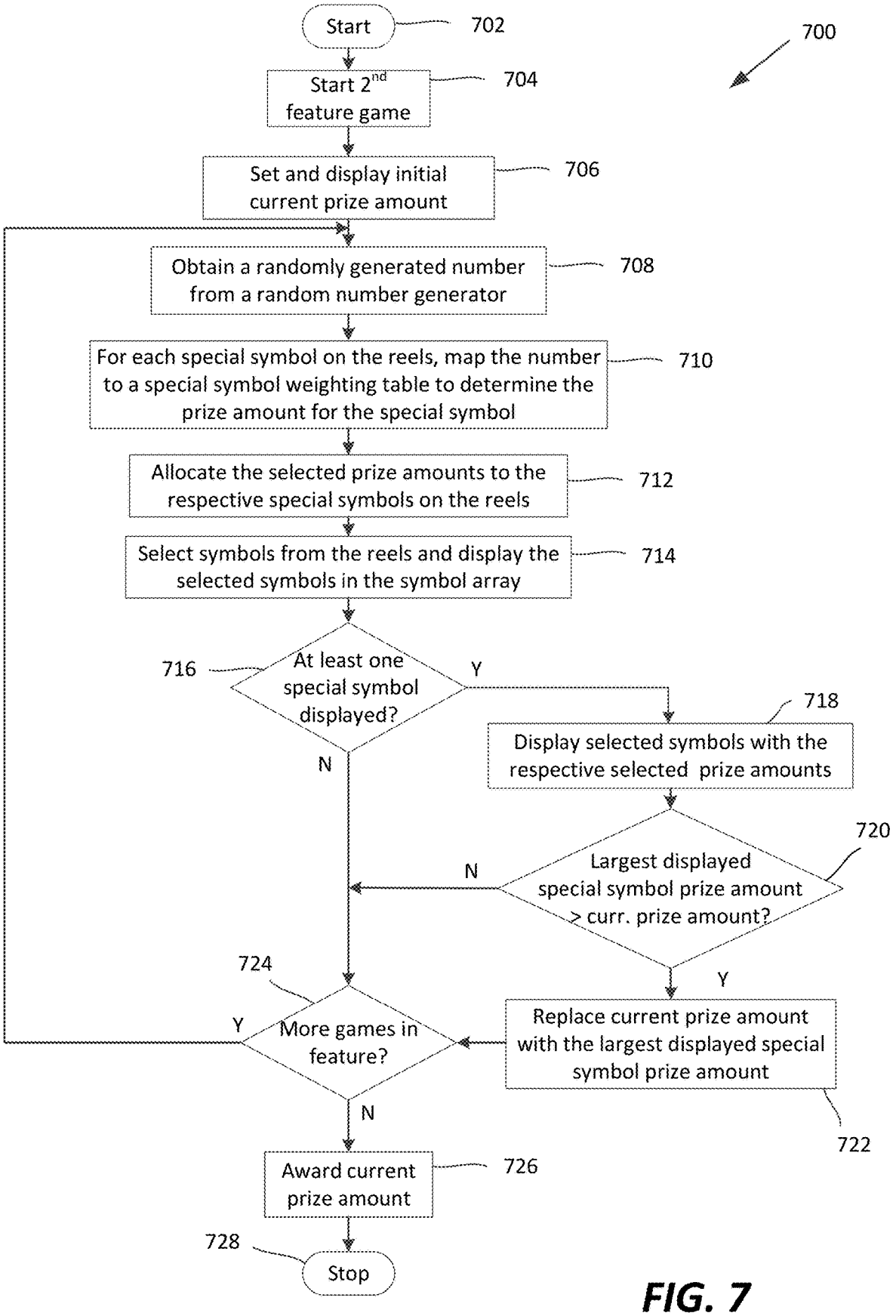
FIG. 7 is a flow chart illustrating an example feature game play process of an example method of gaming.

A flow chart 700 illustrating an example process for implementing a second feature is shown in FIG. 7 and representations of screens displayed to a player during the second feature are illustrated in FIGS. 10 to 23.

Figure 9:
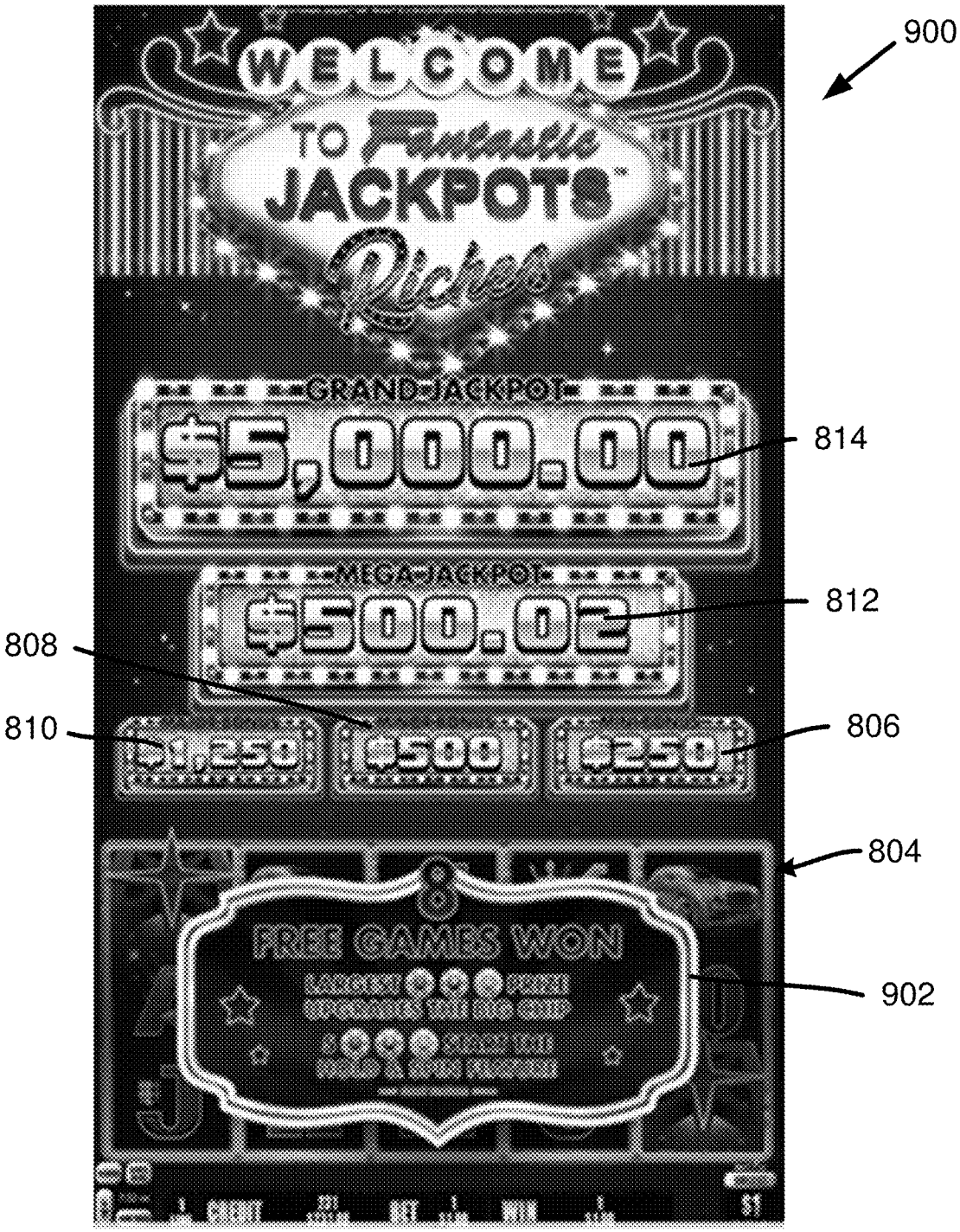
FIG. 9 is an example representation of a screen of an EGM after occurrence of a feature trigger condition.

FIGS. 8 and 9 show representations of screens displayed to a player during triggering of the second feature in a base game.

As shown in FIG. 8, 3 second trigger symbols 438 are displayed and consequently the second feature is triggered.

A representation of a screen 900 displayed to a player on a gaming machine after triggering the second feature is shown in FIG. 9, the screen 900 showing a banner 902 indicating to the player that the second feature has triggered and the number of second feature game instances available. In this example, 8 second feature game instances are provided in the second feature.

After starting the second feature, as indicated at step 704, an initial current prize amount 1002 is set and displayed, as indicated at step 706.

In this example, the initial current prize amount 1002 is equal to the current bet denomination, although it will be understood that any suitable initial amount is envisaged, for example, an amount determined randomly or pseudo randomly (such as the bet denomination multiplied by a randomly chosen multiplier).

Figure 10:
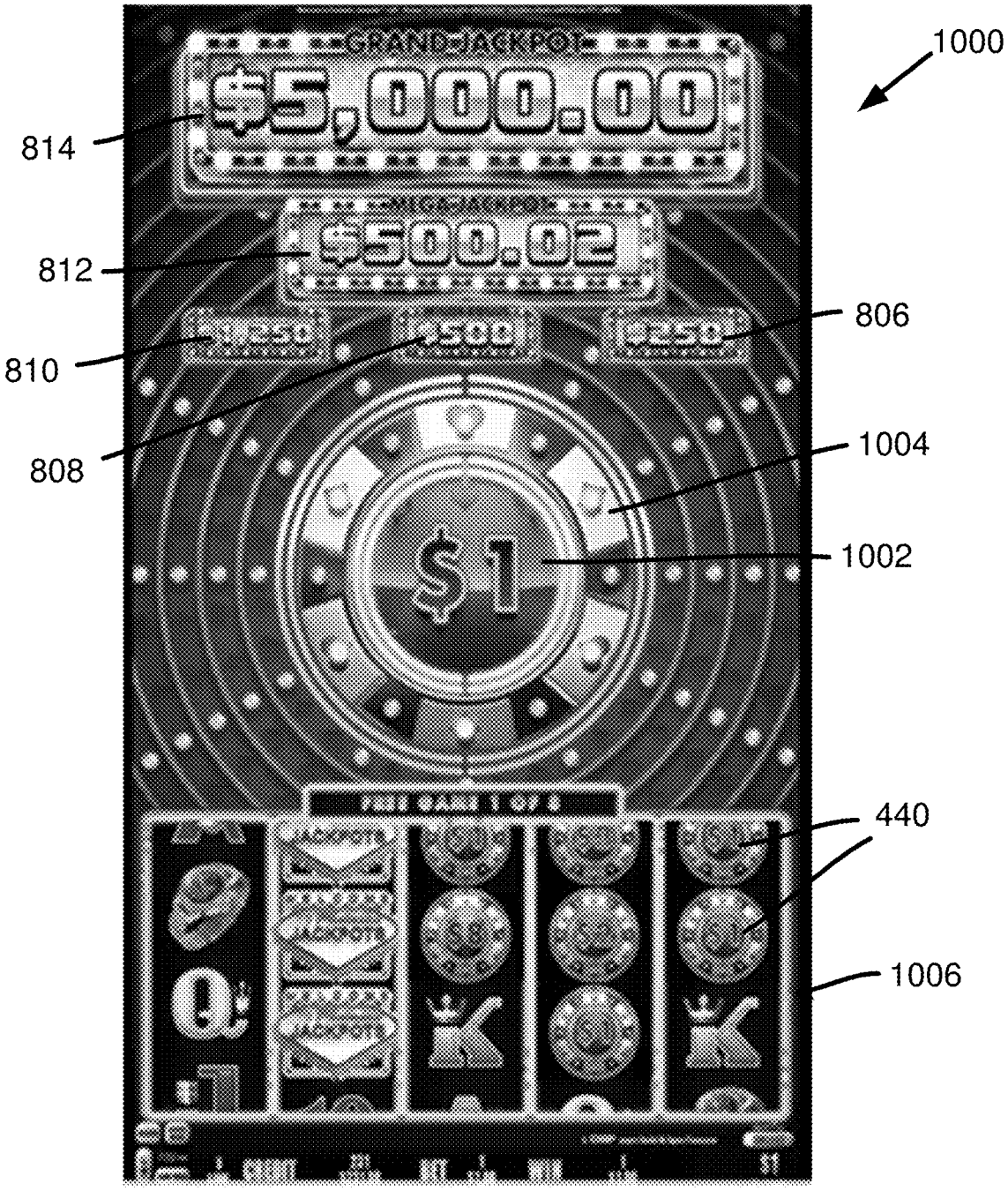
FIG. 10 is an example representation of a screen of an EGM at commencement of a feature game instance.

A representation 1000 of a screen displayed to a player on a gaming machine at commencement of a second feature is shown in FIG. 10. In this example, the current prize amount 1002 is displayed as part of a current prize casino chip 1004 that is of increased size relative to the casino chips corresponding to the special symbols 440 (SCAT2). The current prize casino chip 1004 serves to indicate to the player the value of the current prize amount for the second feature.

For each second feature game instance, the symbol prize determiner 345 in association with the random number generator 212 selects a prize amount for each special symbol on the reels by obtaining a randomly generated number, mapping the number to the special symbol weighting table to obtain a prize amount for the random number, and allocating the obtained prize amounts to the respective special symbols on the reels, as indicated at steps 708, 710 and 712.

For each second feature game instance, the selector 332 in association with the random number generator 212 then selects several symbols for display in a symbol array 1006, as indicated at step 714. In this example, the same reel strips 421, 422, 423, 424, 425 as used during the base game are used during the second feature, although it will be understood that the use of different reel strips are envisaged.

Figure 11:
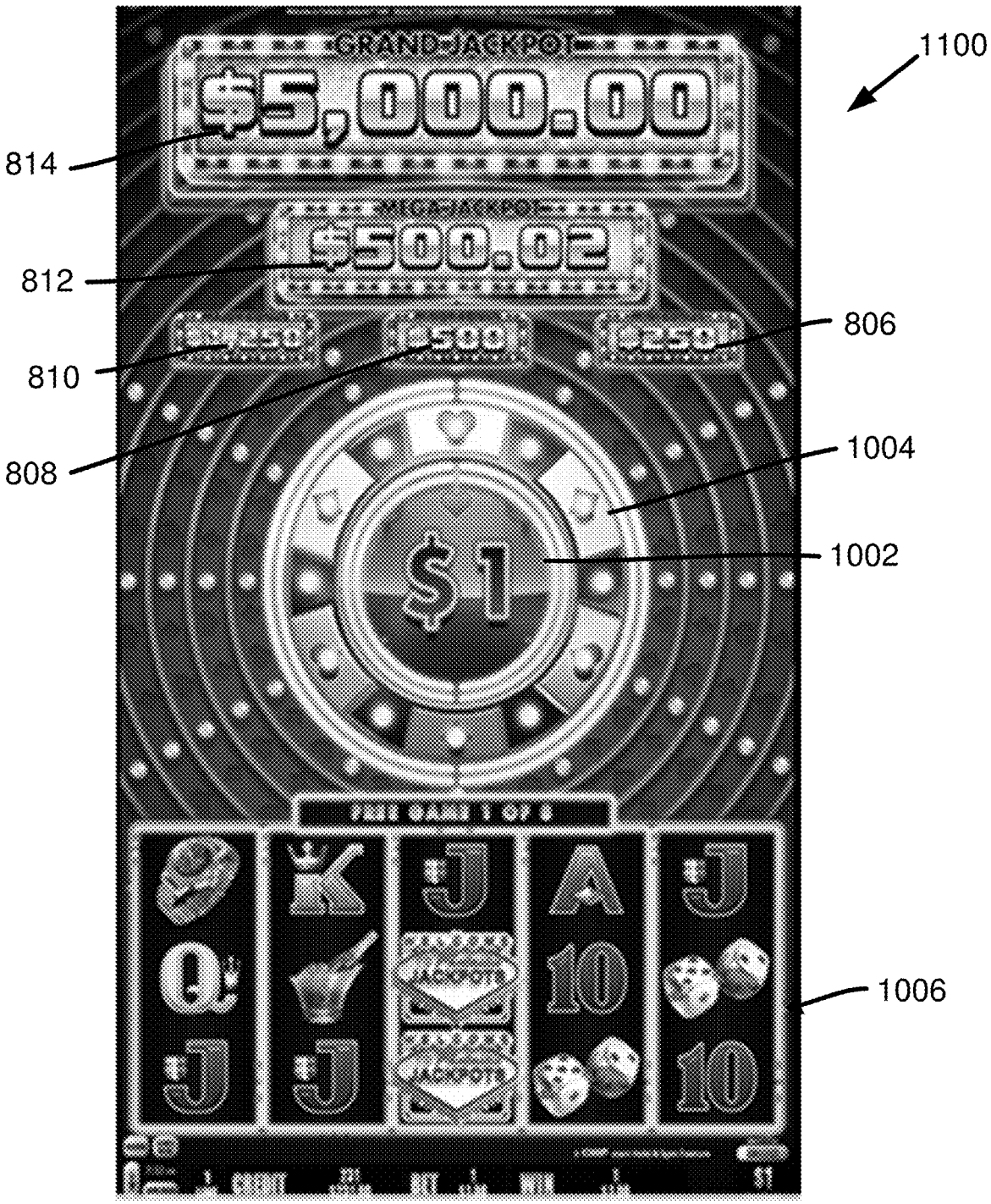
FIG. 11 is an example representation of a screen of an EGM during implementation of a feature game instance when no special symbols are selected.

A representation of a screen 1100 displayed to a player on a gaming machine after the reels have stopped spinning is shown in FIG. 11.

During each game instance of the second feature, if a second special symbol 440 is displayed at step 716 that has an associated prize amount bigger than the current prize amount 1002 displayed on the current prize casino chip 1004, the special symbol prize amount replaces the current prize amount 1002, as indicated at steps 718, 720 and 722.

As shown in FIG. 11, no second special symbols are displayed and accordingly no change is made to the current prize amount 1002.

Figure 12:
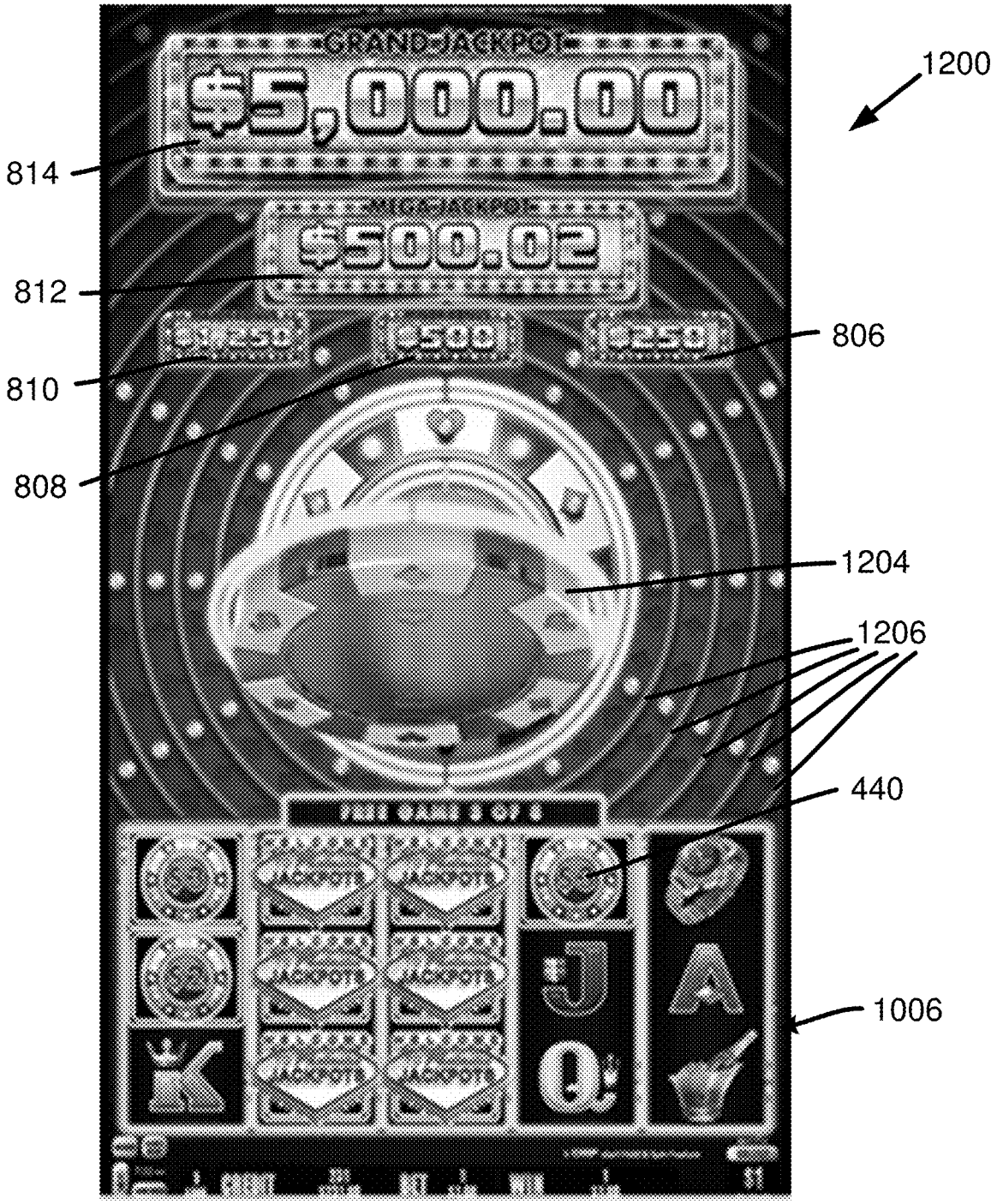
FIG. 12 is an example representation of a screen of an EGM during implementation of a feature game instance when several special symbols are selected and at least one special symbol has an assigned prize amount that is larger than a displayed prize amount.
Figure 13:
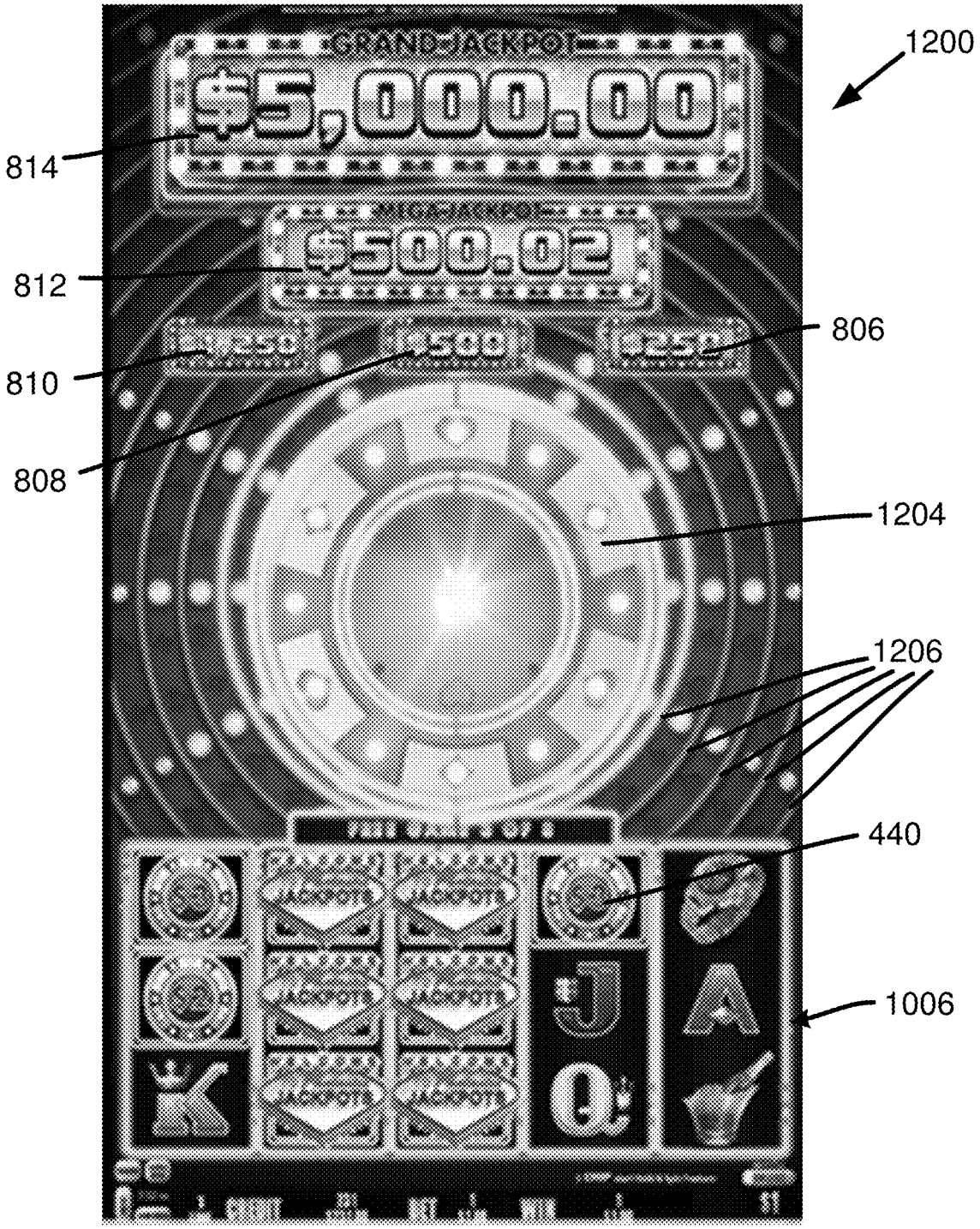
FIGS. 13 to 20 are example representations of screens of an EGM during implementation of a feature game instance showing an animation implemented when a prize amount associated with a special symbol replaces the displayed current prize amount.
Figure 14:
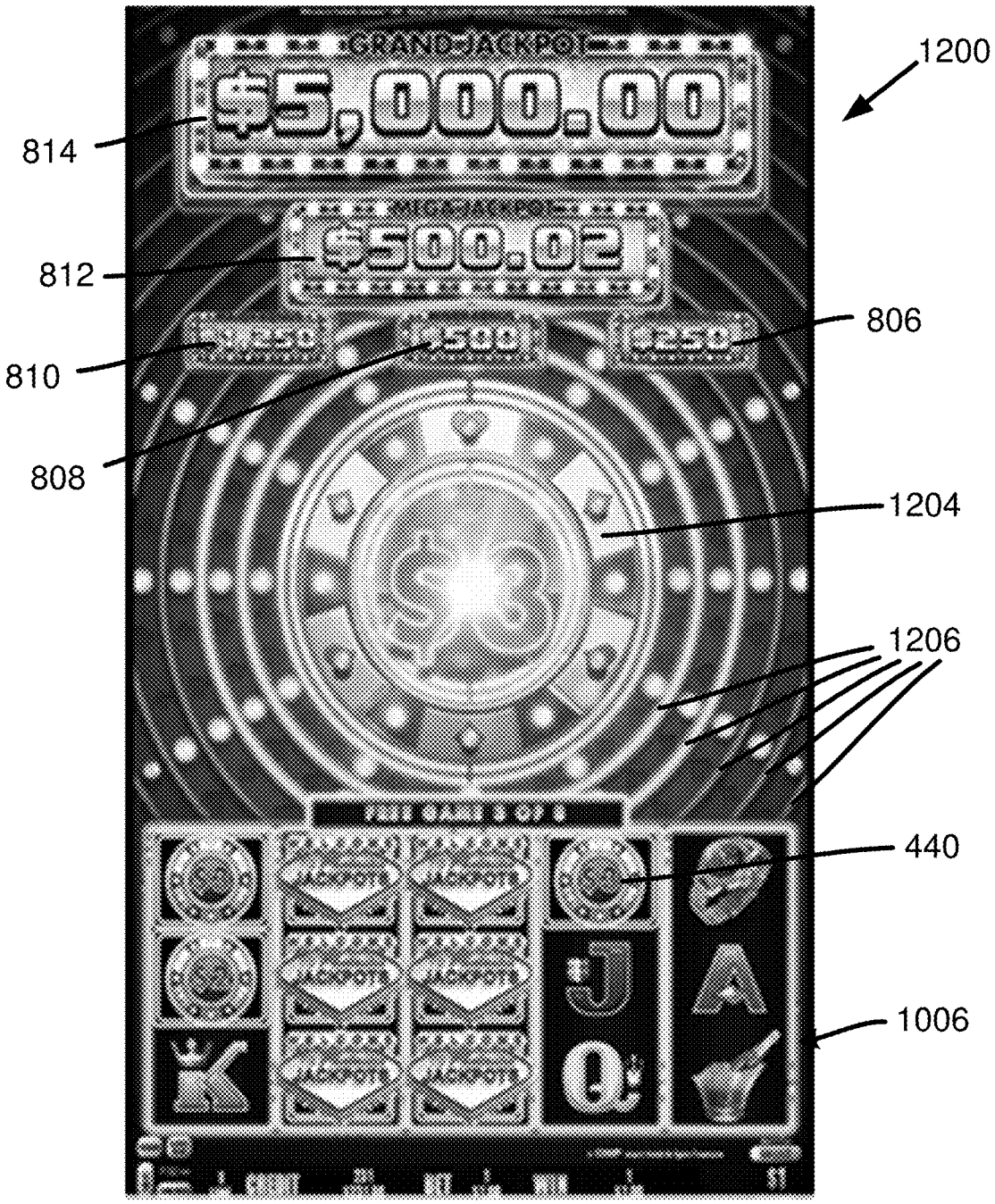
Figure 15:
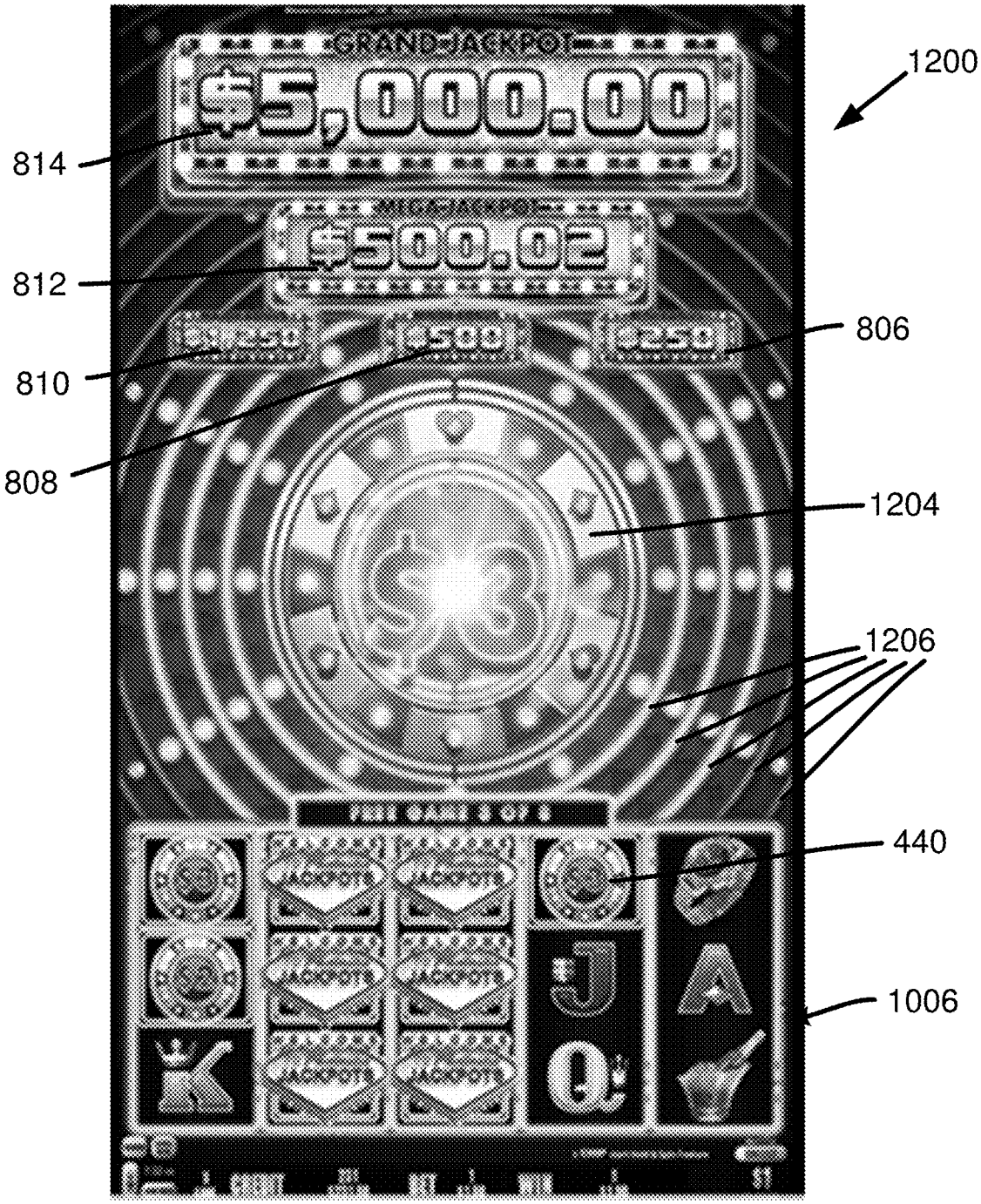
Figure 16:
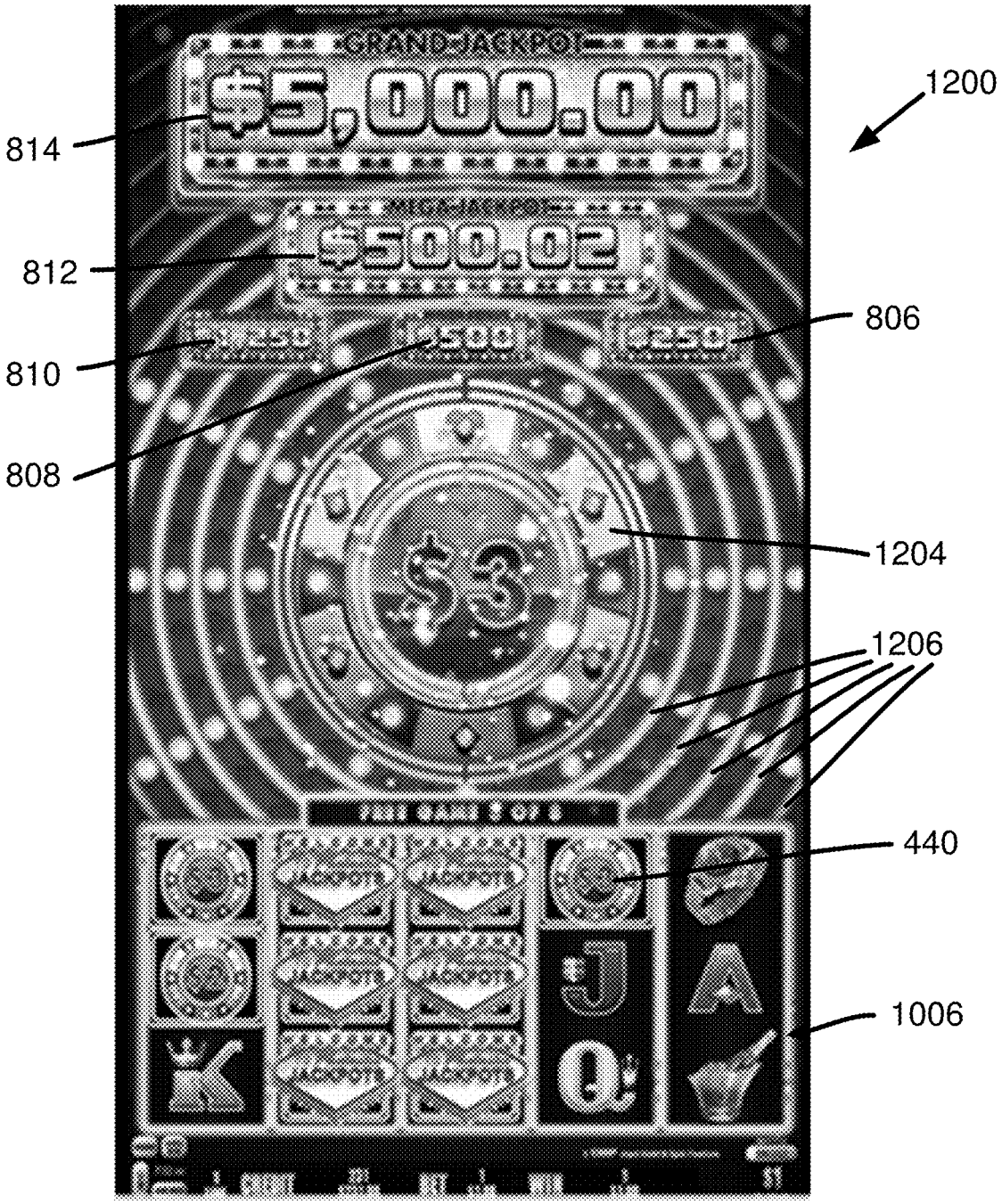
Figure 17:
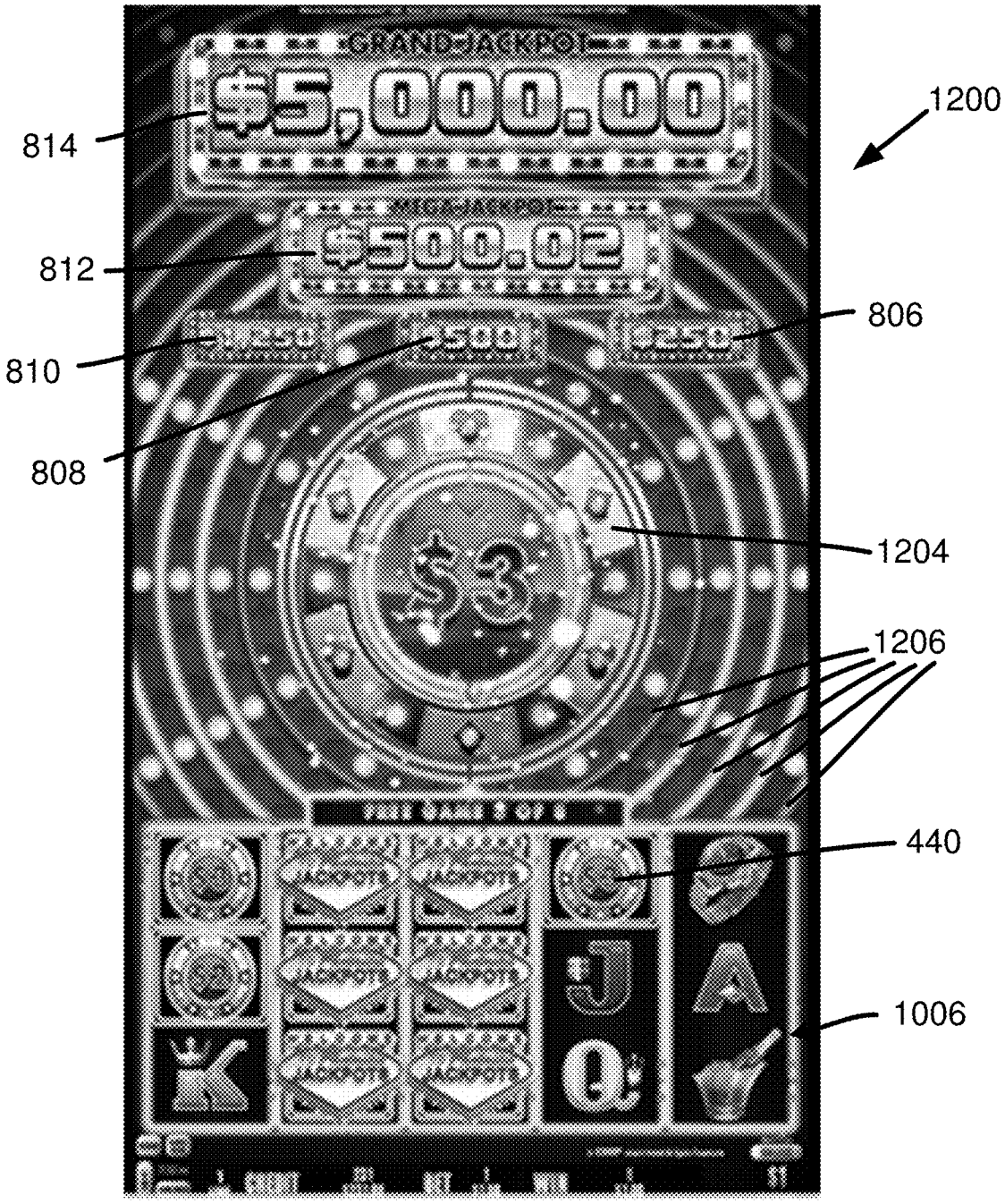
Figure 18:
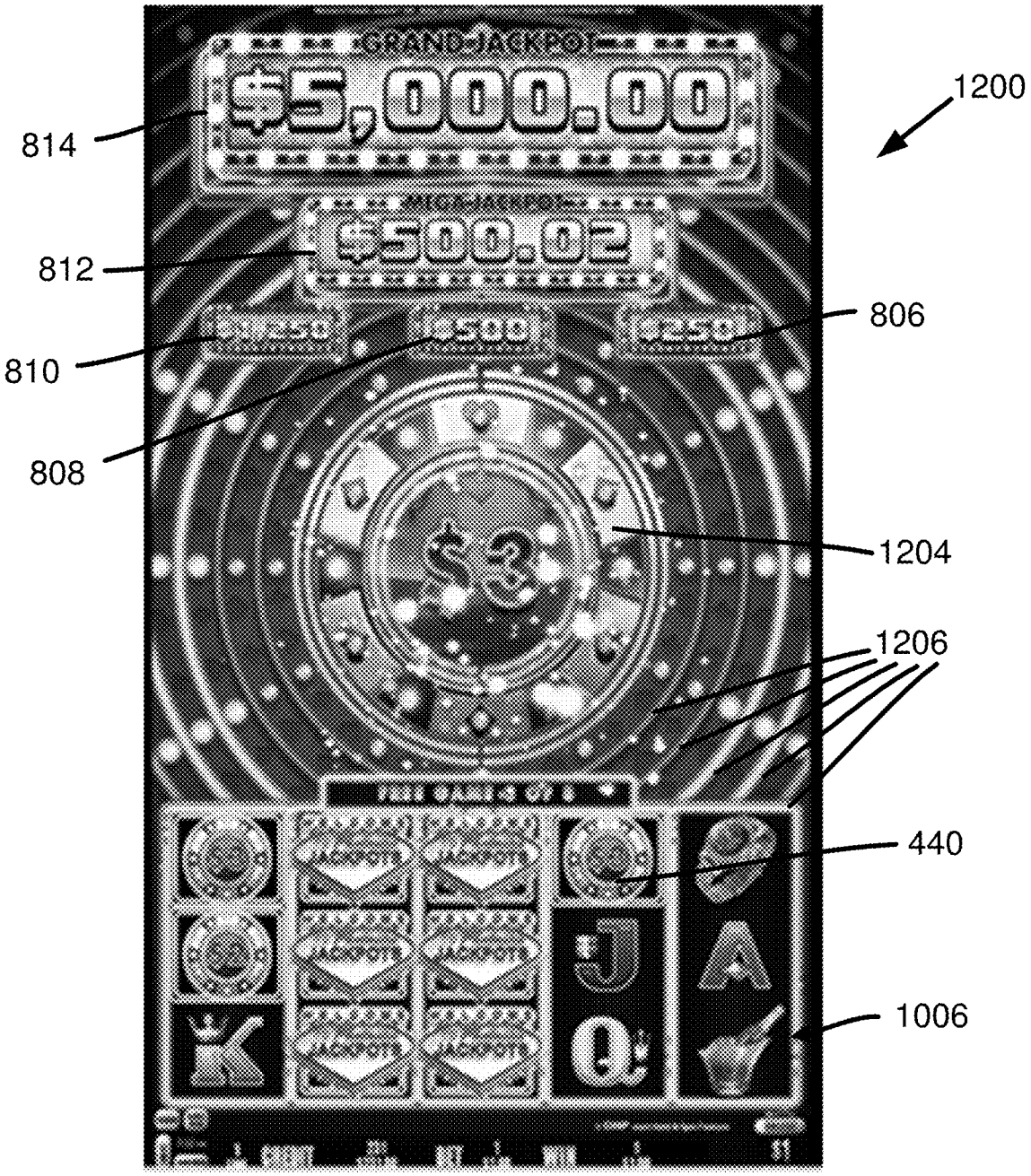
Figure 19:
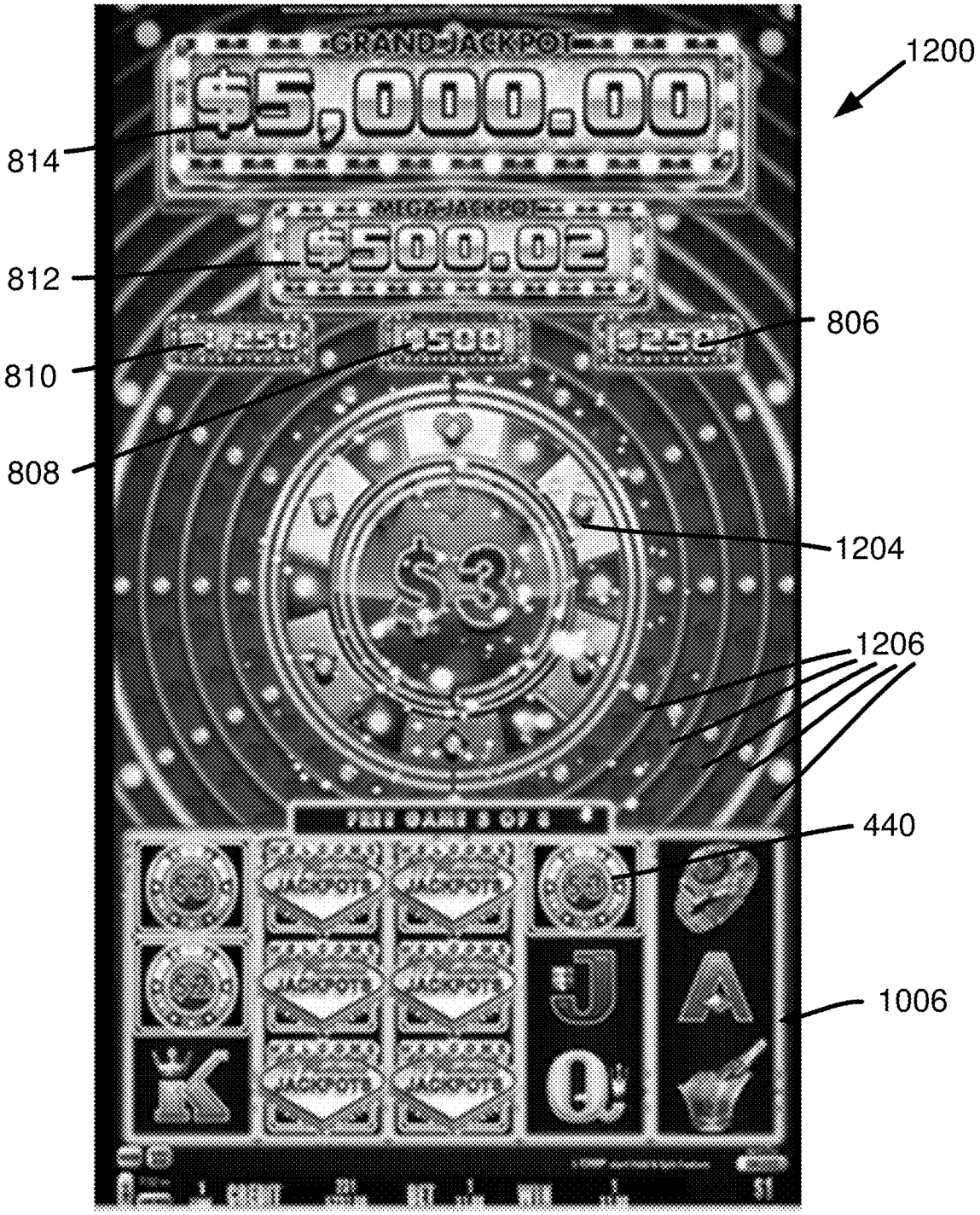
Figure 20:
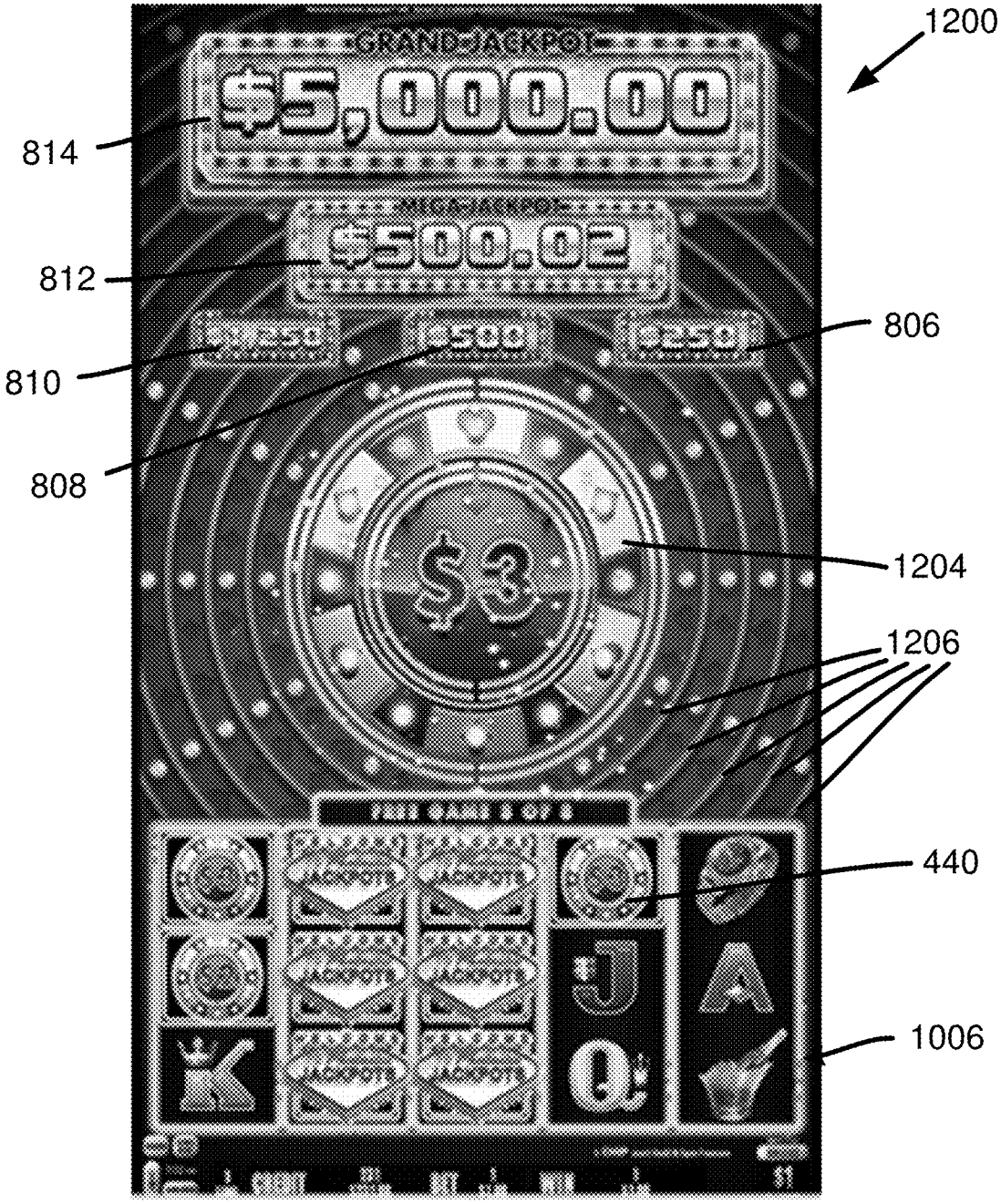

A representation of a screen 1200 displayed to a player on a gaming machine during a subsequent game instance of the second feature is shown in FIGS. 12 to 20. As shown in FIG. 12, in this game instance 3 special symbols 440 have been selected and the highest prize value of the selected special symbols 440 is $3, which is greater than the current prize amount 1002 ($1). As a consequence, the current prize amount is replaced with $3.

As shown in FIGS. 12 to 20, in this example an animation is played that first involves a representation of a chip 1204 moving from the relevant second special symbol 440 in the symbol matrix 1006 to the current prize casino chip 1004. The animation also involves successive illumination then successive extinguishing of ring portions 1206 as indicated by an animation sequence shown in FIGS. 13 to 20, which provides a player with the impression of an outwardly radiating illumination sequence then an outwardly radiating extinguishing sequence.

Figure 21:
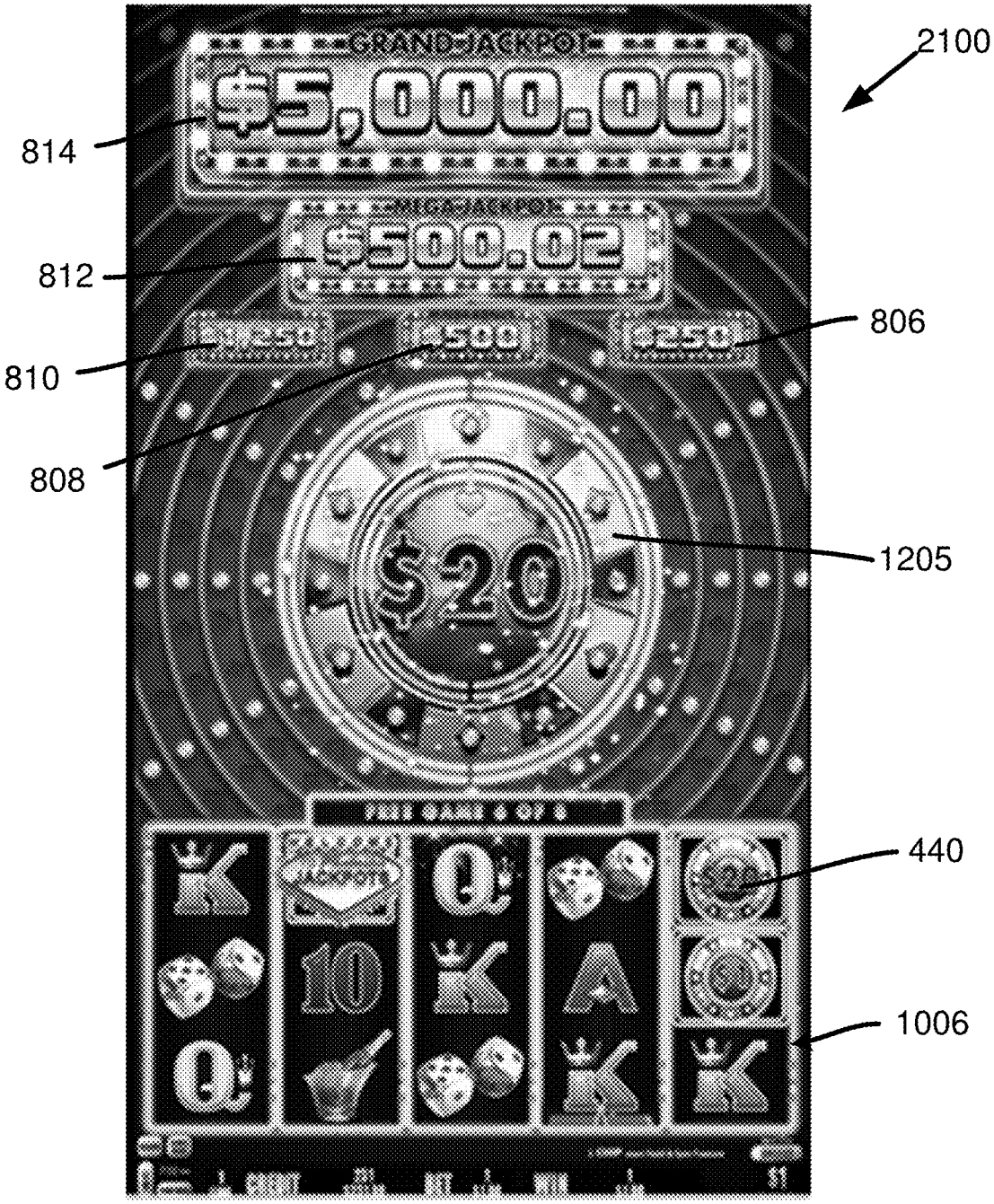
FIG. 21 is an example representation of a screen of an EGM during implementation of a further feature game instance when a prize amount associated with a displayed special symbol is larger than the displayed current prize amount.

A representation of a screen 2100 displayed to a player on a gaming machine during a further game of the second feature is shown in FIG. 21. As shown in FIG. 21, in this game 2 special symbols 440 have been selected, and the highest prize value of the selected special symbols 440 is $20, which is greater than the current prize amount ($3) for the previous chip 1204. As a consequence, the current prize amount is replaced with $20, on a new chip 1205, and an animation sequence as shown in FIGS. 13 to 20 is displayed.

If a second special symbol 440 is selected that has an associated bonus prize amount—MINI, MINOR or MAJOR—and the bonus prize amount associated with the displayed special symbol is of greater value than the current prize amount, the bonus prize amount associated with the displayed special symbol replaces the current prize amount.

Figure 22:
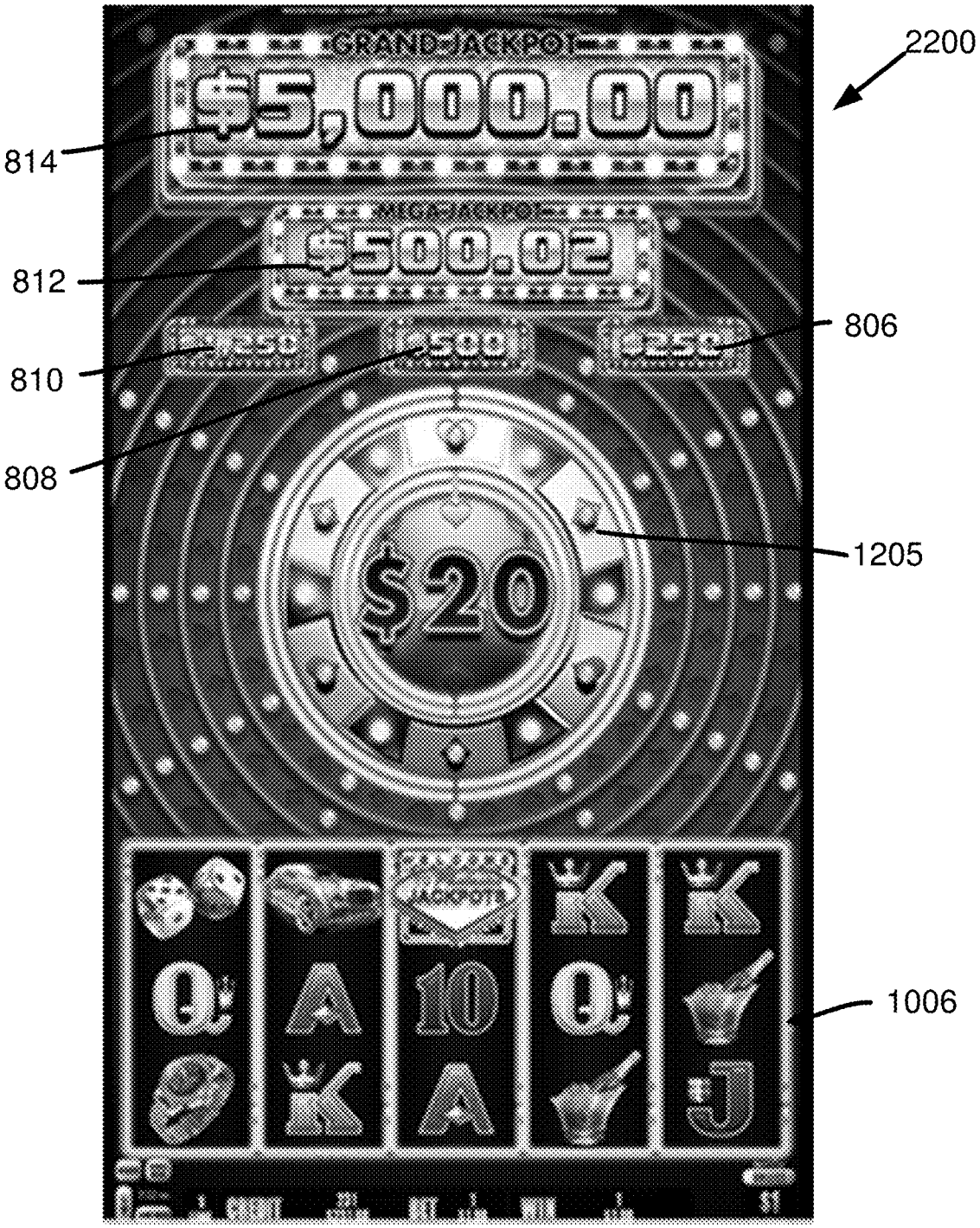
FIG. 22 is an example representation of a screen of an EGM during implementation of a final feature game instance.
Figure 23:
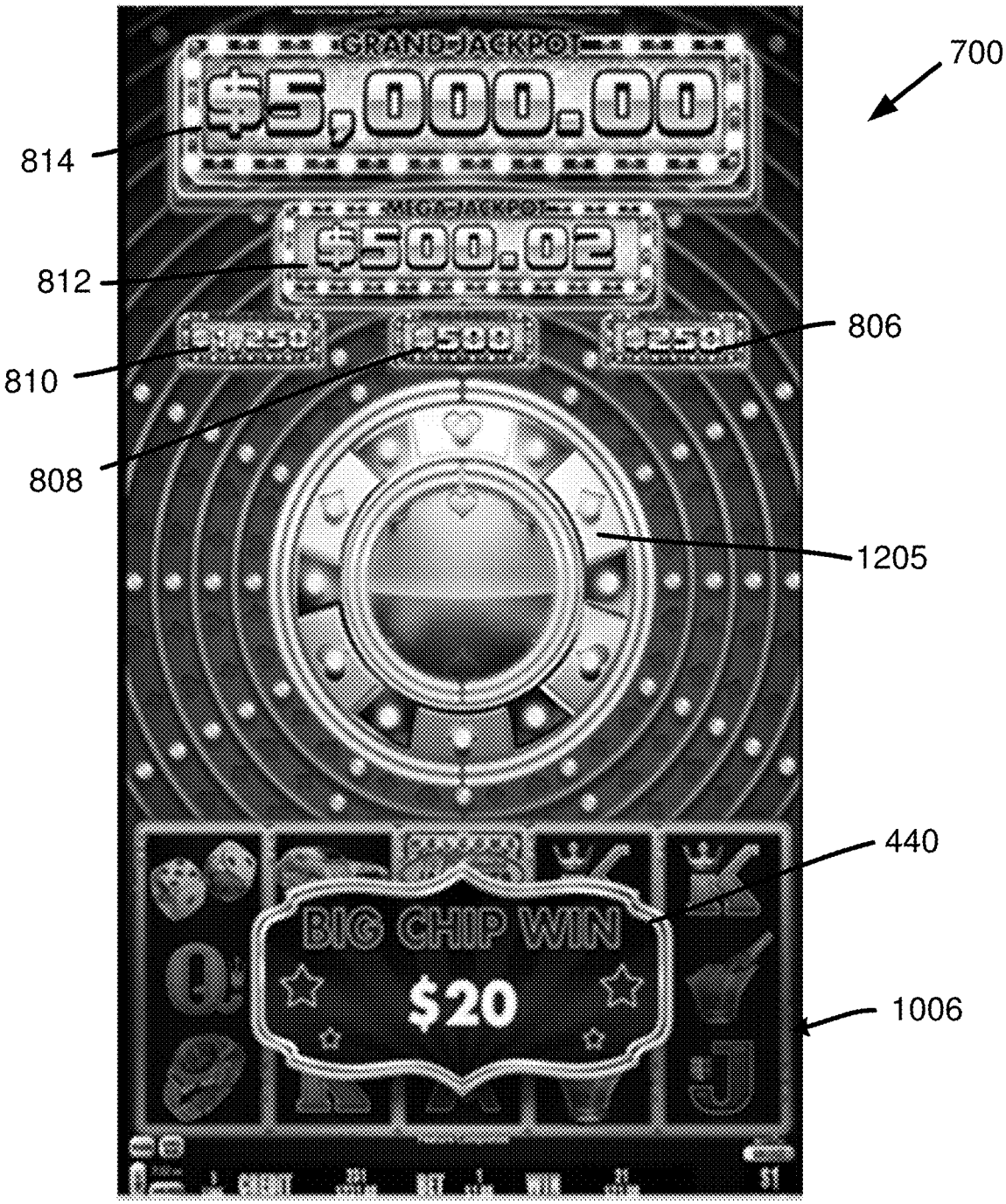
FIG. 23 is an example representation of a screen of an EGM during implementation of a feature after completion of all feature game instances of the feature.

A representation of a screen 2200 displayed to a player during a further game of the second feature is shown in FIG. 22.

As shown in FIG. 22, no second special symbols are displayed and accordingly no change is made to the current prize amount.

As indicated at steps 622, 724 and 726, if no more feature game instances are available in the second feature, the current prize amount is awarded to the player and the second feature completes.

As indicated at steps 618 and 620 of the flow chart 600 shown in FIG. 6, in this example, it is also possible to trigger the first feature from the second feature if the first trigger condition occurs during the second feature, in this example selection and display of 6 or more trigger symbols (SCAT2) 440. If the first feature is triggered from the second feature, the second feature is suspended and the first feature is implemented. Information indicating to the player that the second feature is suspended and will continue after completion of the first feature may be displayed to the player, for example, by displaying an icon such as a representation of the second trigger symbol (SCAT1). Since the SCAT1 symbol is used to trigger the second feature, it is therefore representative of the second feature for the player.

In a variation, the current prize casino chip 1004 is also considered during the second feature game instances as a displayed SCAT2 symbol, since in this example the SCAT2 symbols are casino chips, and consequently the current prize casino chip 1004 is taken into account by the first feature game trigger determiner 338 when determining whether a first feature trigger has occurred such that selection and display of 5 or more SCAT2 symbols 440 in the symbol array 1006 causes the first feature to trigger. In effect, the first trigger condition during the second feature is modified to have reduced requirements compared to those outside the second feature.

In this example, if the first feature is triggered from the second feature, an animation is played wherein a copy of the current prize casino chip 1004 moves to the symbol array 1006 and lands on a display position that may be selected randomly or pseudo randomly using the random number generator 212.

In a variation, it is also possible to retrigger the second feature during a second feature game instance, for example, if the second trigger condition occurs, in this example selection and display of 3 second trigger symbols (3 SCAT1 symbols 438). Information indicating to the player that a further second feature is queued and will be implemented after completion of the current second feature may be displayed to the player, for example, by displaying an icon such as a representation of the second trigger symbol (SCAT1), for example, with a number to indicate the number of queued second features. Since the SCAT1 symbol is used to trigger the second feature, it is therefore representative of the second feature for the player.

In this example, progressive jackpots (MEGA or GRAND) are awarded in various ways.

For example, during a base game, the first feature or the second feature, a GRAND jackpot may be triggered based on selection and display of symbols that satisfy a GRAND jackpot triggering condition, such as selection and display of at least 15 defined symbols, in this example 15 or more SCAT2 symbols. During the second feature, the current prize casino chip 1004 may be taken into account when determining whether a GRAND jackpot has occurred such that selection and display of 14 or more SCAT2 symbols 440 causes the GRAND jackpot to trigger.

During a base game, a MEGA jackpot may be triggered based on selection and display of symbols that satisfy a MEGA jackpot triggering condition, such as selection and display of at least 15 defined symbols, in this example 15 or more SCAT2 symbols, wherein at least one of the SCAT2 symbols has a MEGA prize amount associated with it. During the first feature, the MEGA jackpot is awarded when a feature symbol is selected that has a MEGA prize amount associated with it. In this example, the MEGA jackpot is not awarded in the second feature.

A progressive jackpot (MEGA or GRAND) may also be awarded randomly, for example, based on a random trigger if the selected and displayed symbols meet defined qualifying criteria. For example, the GRAND jackpot may be awarded during a base game, the first feature or the second feature if the first feature is not triggered based on the selected and displayed symbols (less than 6 SCAT2 symbols are selected and displayed) and a GRAND random trigger has occurred. Similarly, the MEGA jackpot may be awarded during a base game if the first feature is not triggered based on the selected and displayed symbols (less than 6 SCAT2 symbols are selected and displayed) and a MEGA random trigger has occurred. In this example, the MEGA jackpot is not randomly awarded in the second feature.

In accordance with a first aspect of the present invention, there is provided a gaming system comprising: at least one display; a game controller that includes at least one processor and at least one memory device, wherein: the at least one processor, the at least one memory device, and the at least one display are operably connected; and the at least one memory device stores computer-readable instructions for controlling the at least one processor to: implement a feature including a plurality of game instances; for each game instance, select a plurality of symbols from a set of symbols, the set of symbols including a plurality of special symbols, each special symbol having an associated prize amount; for each game instance, display the selected symbols in a symbol array; for each game, display a current prize amount that is persistent across all game instances of the feature; for each game instance, determine whether at least one selected special symbol has an associated prize amount that is greater than the current prize amount; for each game instance, if the determination is that at least one special symbol has an associated prize amount that is greater than the current prize amount, replace the current prize amount with the largest prize amount associated with the at least one selected special symbol; and award the current prize amount to a player when all game instances of the feature have been completed.

In an embodiment, the at least one memory device stores computer-readable instructions for controlling the at least one processor to randomly or pseudo randomly select each prize amount to be associated with each special symbol.

In an embodiment, the prize amount is determined by randomly or pseudo randomly selecting a number and mapping the number to a weighting table that includes a plurality of number ranges and a plurality of prize values respectively associated with the number ranges.

In an embodiment, a plurality of different prize amounts are available for association with a special symbol, and the prize amounts include any one of more of the following: at least one fixed prize amount; at least one prize amount that is dependent on the bet denomination; and/or at least one bonus label associated with a defined bonus amount.

In an embodiment, the plurality of prize amounts available for selection for association with a special symbol is dependent on a selected bet denomination.

In an embodiment, the at least one memory device stores computer-readable instructions for controlling the at least one processor to set an initial value for the current prize amount, for example, based on a selected bet denomination.

In an embodiment, the current prize amount is displayed in association with a current prize symbol that is displayed separately to the selected symbols and has an appearance substantially similar to the appearance of a special symbol.

In an embodiment, the at least one memory device stores computer-readable instructions for controlling the at least one processor to vary the appearance of the current prize symbol according to value of the prize amount associated with the current prize symbol.

In an embodiment, the current prize symbol has a first characteristic, such as gold color, when the prize amount associated with the current prize symbol is above a first defined value; has a second characteristic, such as silver color, when the prize amount associated with the current prize symbol is between the first defined value and a second defined value less than the first defined value; and has a third characteristic, such as bronze color, when the prize amount associated with the current prize symbol is less than the second defined value.

In an embodiment, each of the special symbols and the current prize symbol is a representation of a casino chip with a displayed value corresponding to the selected prize amount.

In an embodiment, the current prize symbol is larger than a special symbol.

In an example, the at least one memory device stores computer-readable instructions for controlling the at least one processor to, before implementing the feature: implement a base game; determine whether a trigger condition has occurred during the base game; and implement the feature when the trigger condition is determined to have occurred.

In an embodiment, the trigger condition includes display of at least one defined symbol.

In an embodiment, the at least one memory device stores computer-readable instructions for controlling the at least one processor to queue a further feature when the trigger condition occurs during the feature, and implement the further feature after completion of the feature.

In an embodiment, the at least one memory device stores computer-readable instructions for controlling the at least one processor to display an identifier indicative of the queued further feature.

In an embodiment, the at least one memory device stores computer-readable instructions for controlling the at least one processor to, before implementing the feature: implement a different feature when a different trigger condition is determined to have occurred in the base game or the feature.

In an embodiment, the different trigger condition includes selection and display of at least one defined symbol.

In an embodiment, the at least one memory device stores computer-readable instructions for controlling the at least one processor to, during implementing the feature: suspend the feature when the different trigger condition occurs in the feature; implement the different feature; and after completion of the different feature, continue the feature.

In an embodiment, the at least one defined symbol of the different trigger condition includes the current prize symbol.

In an embodiment, the at least one memory device stores computer-readable instructions for controlling the at least one processor to display an identifier indicative of the suspended feature during implementation of the different feature.

In an embodiment, the at least one memory device stores computer-readable instructions for controlling the at least one processor to: maintain at least one jackpot pool, wherein at least one gaming machine progressively contributes an amount to the jackpot pool; and award a jackpot win amount to a player from the at least one jackpot pool based on defined criteria.

In an embodiment, the defined criteria include selection and display of at least one defined symbol.

In an embodiment, the at least one defined symbol of the defined criteria includes the current prize symbol.

In an embodiment, the defined criteria include a random or pseudo random determination as to whether to award the jackpot.

In accordance with a second aspect of the present invention, there is provided a method of gaming comprising: implementing a feature including a plurality of game instances; for each game instance, selecting a plurality of symbols from a set of symbols, the set of symbols including a plurality of special symbols, each special symbol having an associated prize amount; for each game instance, displaying the selected symbols in a symbol array; for each game instance, displaying a current prize amount that is persistent across all game instances of the feature; for each game instance, determining whether at least one selected special symbol has an associated prize amount that is greater than the current prize amount; for each game instance, if the determination is that at least one special symbol has an associated prize amount that is greater than the current prize amount, replacing the current prize amount with the largest prize amount associated with the at least one selected special symbol; and awarding the current prize amount to a player when all game instances of the feature have been completed.

While the invention has been described with respect to the figures, it will be appreciated that many modifications and changes may be made by those skilled in the art without departing from the spirit of the invention. Any variation and derivation from the above description and figures are included in the scope of the present invention as defined by the claims. In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope and spirit of these claims.

We claim:

1. A computer system comprising one or more processors and memory readable by the one or more processors, the memory having stored thereon computer-executable instructions for causing the one or more processors, when programmed thereby, to perform operations to control an electronic gaming device, the operations comprising:

determining that a feature has been triggered in a base reel game, the feature using multiple reels in a symbol array, the feature having multiple instances;

setting a current value for the feature to have an initial value, the current value for the feature being persistent across the multiple instances of the feature, wherein a current value symbol to be displayed on a screen of the electronic gaming device graphically indicates the current value for the feature;

for each of the multiple instances of the feature:

selecting multiple symbols from a set of symbols, the set of symbols including multiple special symbols, each of the multiple special symbols having an associated value, wherein the selecting the multiple symbols from the set of symbols uses a random number generator ("RNG") to determine positions at which to stop the reels, respectively, in the symbol array;

determining whether any of the selected multiple symbols is a special symbol having an associated value greater than the current value for the feature;

if so, replacing the current value for the feature with a largest associated value among the selected multiple symbols and causing generation, for display on the screen of the electronic gaming device, of an updated version of the current value symbol; and otherwise, not changing the current value for the feature; and after the multiple instances of the feature have been completed, determining an outcome of the feature based on the current value for the feature.

2. The computer system of claim 1, wherein the operations further comprise, for a given special symbol of the multiple special symbols, selecting the associated value for the given special symbol, including:

generating a random or pseudo-random number; and using a table to map the random or pseudo-random number to the associated value for the given special symbol, wherein the table includes multiple number ranges and multiple values respectively associated with the multiple number ranges.

3. The computer system of claim 2, wherein the multiple values include:

at least one fixed value;

at least one value that is dependent on a bet denomination; and/or at least one bonus label associated with a defined bonus value.

4. The computer system of claim 2, wherein the multiple values are dependent on a bet denomination.

5. The computer system of claim 2, wherein the selecting the associated value for the given special symbol occurs before the multiple instances of the feature.

6. The computer system of claim 1, wherein the initial value is based on a bet denomination.

7. The computer system of claim 1, wherein the determining that the feature has been triggered occurs based on an occurrence of a trigger condition during a base game.

8. The computer system of claim 7, wherein the trigger condition includes selection of at least one defined symbol during the base game.

9. The computer system of claim 7, wherein the operations further comprise:

determining that the feature has been triggered again based on occurrence of the trigger condition during one of the multiple instances of the feature; and queuing multiple additional instances of the feature until after the determining the outcome of the feature.

10. The computer system of claim 1, wherein the operations further comprise:

determining that a different feature has been triggered based on occurrence of a different trigger condition during a base game or the feature.

11. The computer system of claim 10, wherein the different trigger condition includes selection of at least one defined symbol during the base game or the feature.

12. The computer system of claim 10, wherein the different trigger condition occurs during the feature, and wherein the operations further comprise:

suspending the feature;

performing the different feature; and after completion of the different feature, continuing the feature.

13. The computer system of claim 1, wherein the operations further comprise:

contributing to at least one jackpot pool.

14. A computer-implemented method of controlling an electronic gaming device, the method comprising:

determining that a feature has been triggered, the feature using multiple reels in a symbol array, the feature having multiple instances;

setting a current value for the feature to have an initial value, the current value for the feature being persistent across the multiple instances of the feature, wherein a given symbol to be displayed on a screen of the electronic gaming device graphically indicates the current value for the feature;

for each of the multiple instances of the feature:

selecting multiple symbols from a set of symbols using a random number generator ("RNG") to determine positions at which to stop the reels, respectively, in the symbol array, the set of symbols including multiple special symbols, each of the multiple special symbols having an associated value;

determining whether any of the selected multiple symbols is a special symbol having an associated value greater than the current value for the feature;

if so, replacing the current value for the feature with a largest associated value among the selected multiple symbols and causing generation, for display on the screen of the electronic gaming device, of an updated version of the given symbol; and otherwise, not changing the current value for the feature; and after the multiple instances of the feature have been completed, determining an outcome of the feature based on the current value for the feature.

15. The method of claim 14, further comprising, for a given special symbol of the multiple special symbols, selecting the associated value for the given special symbol, including:

generating a random or pseudo-random number; and using a table to map the random or pseudo-random number to the associated value for the given special symbol, wherein the table includes multiple number ranges and multiple values respectively associated with the multiple number ranges.

16. A computer system comprising one or more processors and memory readable by the one or more processors, the memory having stored thereon computer-executable instructions for causing the one or more processors, when programmed thereby, to perform operations to control an electronic gaming device, the operations comprising:

displaying, on a screen of the electronic gaming device, a current value symbol that graphically indicates a current value for a feature, the feature having multiple instances and using multiple reels in a symbol array, the current value for the feature having an initial value, and the current value for the feature being persistent across the multiple instances of the feature;

for each of the multiple instances of the feature:

displaying, in the symbol array, multiple symbols selected from a set of symbols, the multiple symbols having been selected from the set of symbols using a random number generator ("RNG") to determine positions at which to stop the reels, respectively, in the symbol array, the set of symbols including multiple special symbols, each of the multiple special symbols having an associated value;

if any of the selected multiple symbols is a special symbol having an associated value greater than the current value for the feature, replacing the current value for the feature with a largest associated value among the selected multiple symbols and displaying, on the screen of the electronic gaming device, an updated version of the current value symbol; and otherwise, not changing the current value for the feature; and after the multiple instances of the feature have been completed, displaying an outcome of the feature based on the current value for the feature.

17. The computer system of claim 16, wherein the current value symbol is displayed separately from the selected multiple symbols.

18. The computer system of claim 17, wherein the current value symbol has an appearance substantially similar to the multiple special symbols but larger than any of the multiple special symbols.

19. The computer system of claim 17, wherein the operations further comprise:

varying appearance of the current value symbol according to the current value, wherein the current value symbol has a first appearance characteristic when the current value is above a first defined value, has a second appearance characteristic when the current value is between the first defined value and a second defined value less than the first defined value, and has a third appearance characteristic when the current value is less than the second defined value.

20. The computer system of claim 19, wherein the first appearance characteristic is a first color, the second appearance characteristic is a second color different than the first color, and wherein the third appearance characteristic is a third color different than the first color and the second color.

* * * * *